US009421428B1

(12) United States Patent
Dobush

(10) Patent No.: US 9,421,428 B1
(45) Date of Patent: Aug. 23, 2016

(54) GAME BALL CLEANING DEVICE AND METHOD

(71) Applicant: House Rules LLC, Richland, WA (US)

(72) Inventor: Tyler Dobush, West Richland, WA (US)

(73) Assignee: House Rules LLC, Richland, WA (US)

( * ) Notice: Subject to any disclaimer, the term of this patent is extended or adjusted under 35 U.S.C. 154(b) by 104 days.

(21) Appl. No.: 14/307,543

(22) Filed: Jun. 18, 2014

Related U.S. Application Data

(63) Continuation-in-part of application No. 13/962,629, filed on Aug. 8, 2013, now abandoned.

(60) Provisional application No. 61/680,952, filed on Aug. 8, 2012.

(51) Int. Cl.
*B08B 3/00* (2006.01)
*A63B 47/04* (2006.01)

(52) U.S. Cl.
CPC ..... *A63B 47/04* (2013.01)

(58) Field of Classification Search
CPC ..... A47L 47/04
See application file for complete search history.

(56) References Cited

U.S. PATENT DOCUMENTS

| | | | |
|---|---|---|---|
| 1,876,851 | A | 9/1932 | Grover |
| 3,460,179 | A | 8/1969 | Falckenberg et al. |
| 3,562,830 | A | 2/1971 | Ruedisueli |
| 4,163,299 | A | 8/1979 | Duda |
| 4,567,618 | A | 2/1986 | Picchietti, Sr. |
| 5,555,586 | A | 9/1996 | Dorrich |
| 5,638,567 | A | 6/1997 | Danyluk |
| 5,647,089 | A | 7/1997 | Hollrock |
| 6,389,639 | B1 | 5/2002 | Worsham |
| 8,028,995 | B2 | 10/2011 | Hoffer |
| 8,151,395 | B2 | 4/2012 | Grotsch |
| 2012/0032402 | A1 | 2/2012 | Comee |

FOREIGN PATENT DOCUMENTS

| | | |
|---|---|---|
| WO | 2012/009529 | 1/2012 |
| WO | WO2012/174614 A1 * | 6/2012 |

* cited by examiner

*Primary Examiner* — Michael Barr
*Assistant Examiner* — Jason Riggleman
(74) *Attorney, Agent, or Firm* — Gearhart Law LLC

(57) ABSTRACT

The present application discloses a device for cleaning a game ball and includes an outer shell housing with a first side and a second side. The first side aligns with the second side to form a recess for receiving a reservoir of fluid. The outer shell accommodates inner shell housing pieces. The inner shell housing includes a first piece and a second piece. The first piece and the second piece align with each other to form an elongated chute which culminates in a funnel. The chute receives the game ball and is where the game ball is cleaned. The device includes a fan located in the inner shell housing and which blows air into the elongated chute. The device also includes a pump located within the reservoir which is in communication with the elongated chute. The device also includes a battery operated power control board which controls the fan and the pump by delivering air and fluid over the game ball.

12 Claims, 25 Drawing Sheets

GAME BALL CLEANING DEVICE AND METHOD

CROSS REFERENCE TO RELATED APPLICATION

This continuation in part application claims priority to U.S. application Ser. No. 13/962,629 filed Aug. 8, 2013 which claims priority to U.S. Patent Application Ser. No. 61/680,952 which was filed on Aug. 8, 2012, the disclosures of which are incorporated herein by reference in their entirety for any purpose whatsoever.

FIELD OF THE EMBODIMENTS

The present disclosure relates to object cleaning assemblies and methods, and in particular embodiments, game ball or ping pong ball washing assemblies and methods.

BACKGROUND OF THE EMBODIMENTS

The recreational and cultural game of Beer Pong is a drinking game involving two teams, plastic cups, ping pong balls and a game table. Two sets of usually ten, six, or three plastic cups are filled with beer, alcohol, soda or any drinkable liquid and placed at either end of the game table in a triangular formation. Each team alternates turns throwing the ping pong balls at the opposing team's plastic cups. When the shooting or serving team throws a ball and lands a ball in one of the opposing team's plastic cups, the opposing team must drink the liquid (before or after the ball is removed from the cup) and remove that plastic cup from the table. Ping Pong balls are recycled and the game continues until one team's plastic cups are entirely removed from the table. As one can imagine, not every ping pong ball thrown will land into the opposing team's cups. Ping pong balls tend to bounce off the game table and roll along very dirty floors or grounds in and around the surrounding game area. Traditionally, ping pong balls that have been landed in an opposing teams cups are rinsed off by dunking the ping pong ball into a separate plastic "wash" cup. After many rinses the wash cup inevitably becomes dirty and filled with a variety of contaminates including but not limited to: debris, sand, dirt, lint, and hairs. Ultimately, the purpose of the wash cup is defeated as the ping pong balls are not sufficiently rinsed by a dirty wash cup. Using a dirty wash cup increases the chances that the returned ping pong ball contains contaminates despite being rinsed. The present application proposes a solution to this problem by effectively rinsing the dirty ping pong ball and enabling the return of a rinsed ping pong ball every time. In addition, the ping pong ball is rinsed each time in a clean environment by uncontaminated fluid thereby decreasing the chances that the returned ping pong ball is dirty. Traditional methods of playing beer pong are represented in FIG. 1. In FIG. 1 a pair of opponents are shown participating in a ping pong game that is typically referred to as "beer pong." During this game, the game ball or ping pong ball is exchanged between sides in an effort to deposit the ping pong ball into at least one cup on the opponent's side, forcing the opponent to consume the liquid within the cup on their side. From time to time, the ping pong ball will exit the table and land on a floor supporting the ping pong table and the opponents. This floor is not always the most sanitary floor as it is typically the floor of a tavern. There may be things such as peanut shells, etc., or other debris associated with bar rooms on the floor. As shown in FIG. 1 the separate plastic cup known as the wash cup is shown off to the side of the game play table. The present application is a separate device which can be placed anywhere.

Other traditional ball cleaning devices known in the art typically involve devices that use abrasive brushes that spin at high speeds to clean a ball, usually a ball bearing, bowling ball or golf ball but none of those devices and mechanisms are capable of cleaning a lightweight ping pong ball. Though the present application can be adapted to clean any game ball of any weight, the present application cleaning mechanism is a multi-stage process involving washing and rinsing using streams of fluid and rotation by air and no abrasive cleaning solutions. In addition, typical ball cleaning devices do not allow for the return of the ball through air. In another embodiment, the reservoir of the device may contain abrasive cleaning solutions.

Portable ball cleaning devices are typically not designed for individual home use nor are they portable. Such devices usually are fixed in a location and cannot be moved nor are typical devices compact enough to set on an indoor dining room or living room.

The present disclosure provides game ball cleaning assemblies and methods that can be used to wash the ping pong ball after it has exited the table and becomes less than sanitary. None of the art described above addresses all of the issues that the present application does.

SUMMARY OF THE EMBODIMENTS

The present application discloses a device for cleaning a game ball and includes an outer shell housing with a first side and a second side. The first side aligns with the second side to form a recess for receiving a reservoir of fluid. The outer shell accommodates inner shell housing pieces. The inner shell housing includes a first piece and a second piece. The first piece and the second piece align with each other to form an elongated chute which culminates in a funnel. The chute receives the game ball and is where the game ball is cleaned. The device includes a fan located in the inner shell housing and which blows air into the elongated chute. The device also includes a pump located within the reservoir which is in communication with the elongated chute. The device also includes a battery operated power control board which controls the fan and the pump by delivering air and fluid over the game ball.

The device includes a fluid leak prevention gasket which fits over the reservoir. The reservoir contains a mesh filter to capture fallen debris off the game ball after rinsing. The funnel includes a circular lip which includes depressions for lifting the game ball off the device. Each side of the outer shell of the device includes a depression for the removal of the reservoir. The device includes a power button for initiating the cleaning sequence. The game ball may be a ping pong ball. The housing may include a plurality of indents for the placement of advertisement stickers. The inner shell housing pieces include opposing extruding pegs for holding the game ball in place while being rinsed.

The present application disclosed a method for cleaning a game ball including a controller which operates in a first mode where the game ball is cleaned within an elongated chute using a mixture of air and fluid; and a second mode where the game ball is ejected out through the elongated chute by a thrust of air. The controller initiates a cleaning sequence for a predetermined amount of time. The controller initiates the lowering of opposing extruding pegs located within the elongated chute where the game ball is placed upon. The controller further directs a fan to produce air and a pump to deliver fluid from a reservoir.

BRIEF DESCRIPTION OF THE EMBODIMENTS

Embodiments of the disclosure are described below with reference to the following accompanying drawings.

DESCRIPTION OF THE PREFERRED EMBODIMENTS

Figure 1:
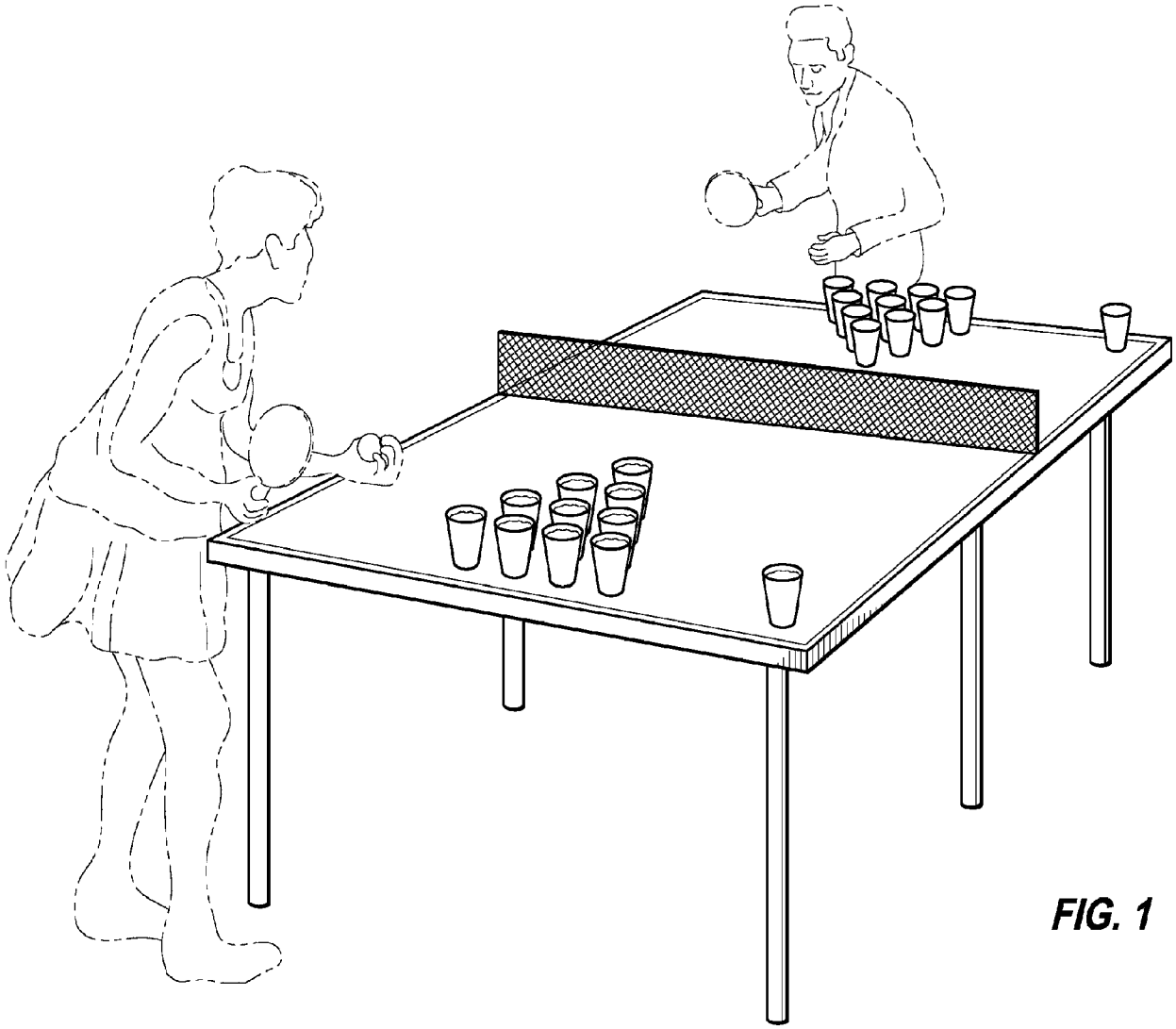
FIG. 1 is a depiction of a pair of opponents participating in beer pong.

This disclosure is submitted in furtherance of the constitutional purposes of the U.S. Patent Laws "to promote the progress of science and useful arts" (Article 1, Section 8). The preferred embodiments of the present application will now be described with reference to the drawings. Identical elements in the various figures are identified with the same reference numerals.

Reference will now be made in detail to each embodiment of the present application. Such embodiments are provided by way of explanation of the present application, which is not intended to be limited thereto. In fact, those of ordinary skill in the art may appreciate upon reading the present specification and viewing the present drawings that various modifications and variations can be made thereto.

Figure 2:
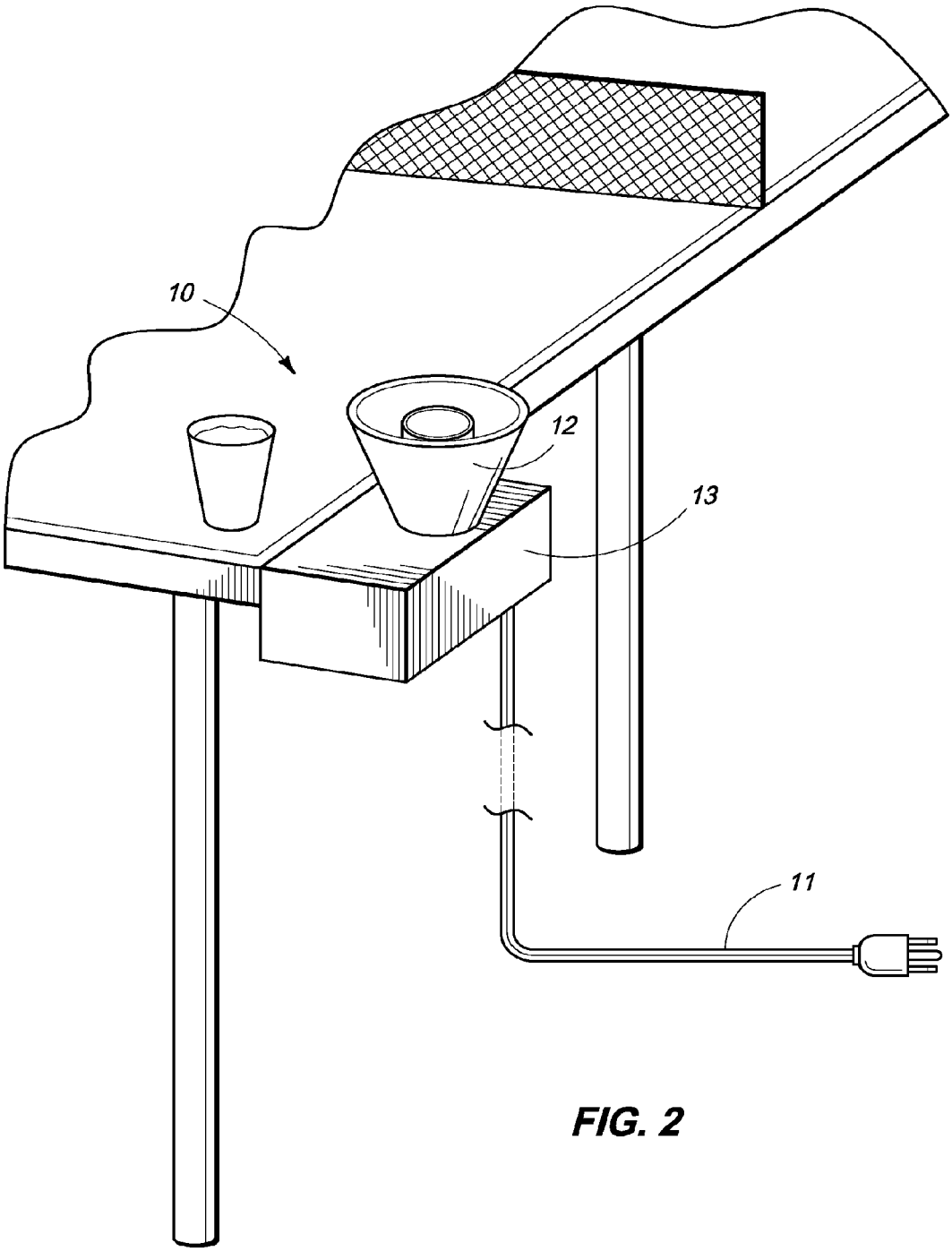
FIG. 2 is an assembly of the present disclosure according to an embodiment.

The assemblies and methods of the disclosure will be described with reference to FIGS. 2-12. Referring to FIG. 2, a game ball cleaning assembly 10 is shown that is coupled to the edge of a game table such as a ping pong table and also includes an assembly for coupling to a power source 11. It is not necessary that assembly 10 be coupled to the game table; it may rest on, underneath, or beside the game table. It is also not necessary that the power source coupling be a typical plug-in power source. Assembly 10 may also be battery operated, for example.

Assembly 10 can include an intake or portal 12 for receiving a ball to be cleaned. Assembly 10 can include a housing that can be constructed of a polymeric material such as hardened plastic, including polycarbonate materials, for example. Housing 13 may be uniformly connected with intake 12, for example, or housing 13 may define intake 12 as well.

Figure 3:
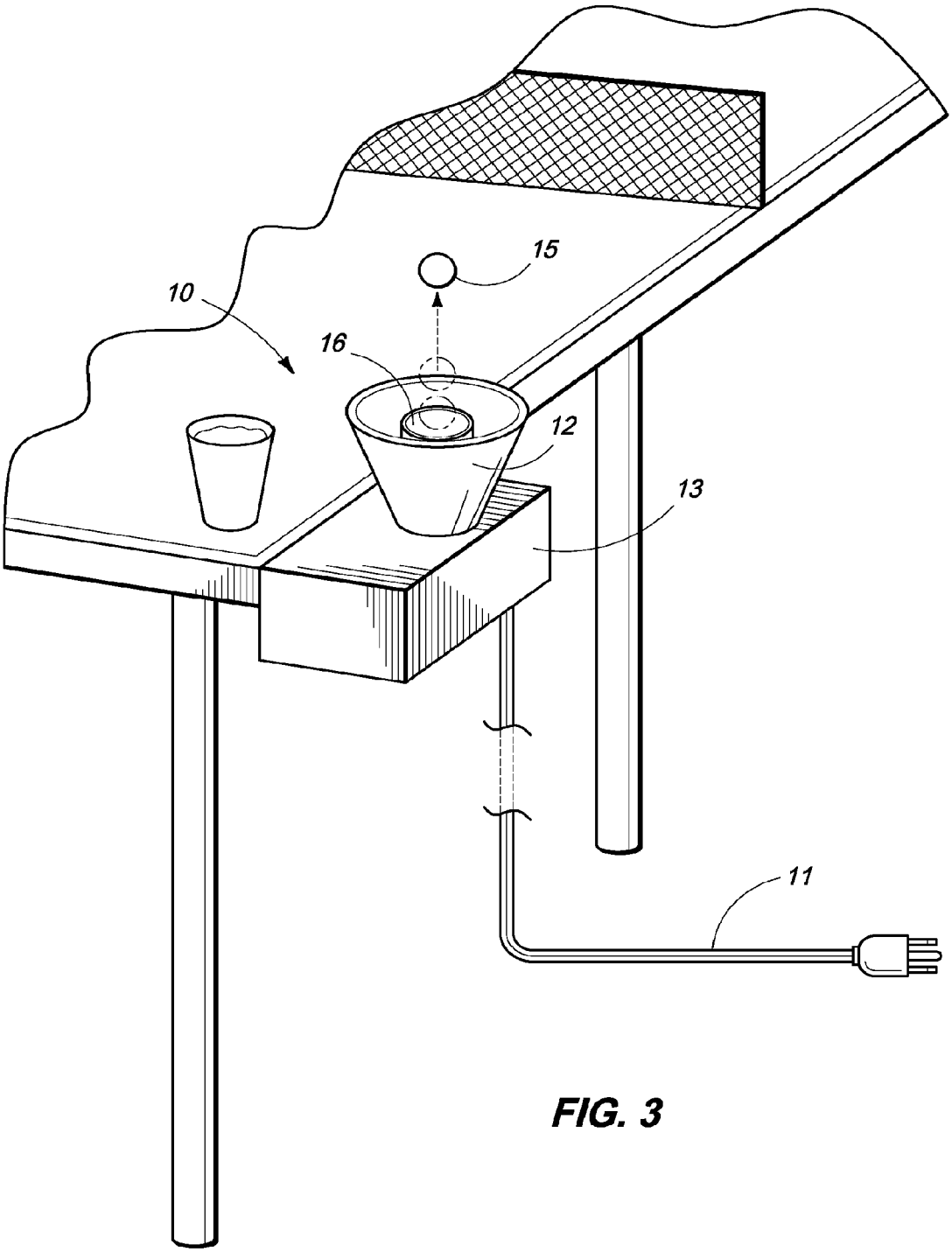
FIG. 3 is another depiction of the assembly of the present disclosure according to an embodiment.

Referring to FIG. 3, game ball 15 can be provided to assembly 10 in an effort to clean ball 15. While example implementations of the present disclosure use a ping pong ball as an example ball, it is contemplated that other balls and/or objects may be cleaned using the subject matter of the present disclosure.

According to an example implementation, the providing of ball 15 to assembly 10 can initiate the cleaning sequence within assembly 10. For example, upon providing the ball, a series of assembly mechanisms are triggered that rinse and/or wash the ball and return the ball back to the operator above assembly 10. In this fashion, the assembly user such as a beer pong player can retrieve a ball that has been sullied after being removed from the table and provide the ball to assembly 10 where it is cleaned and returned to the operator and/or player. In another embodiment, the rinse and/or wash cycle and the ball return function may be triggered by the pushing of a button.

In accordance with example implementations, the assemblies and/or methods of the present disclosure can be used to wash a game ball, such as a ping pong ball. The washing of the ball may be performed with or without an aqueous solution that does or does not include a detergent. As an example, the wash can be performed with fluid alone; as such, the wash may be considered a rinse.

Figure 4:
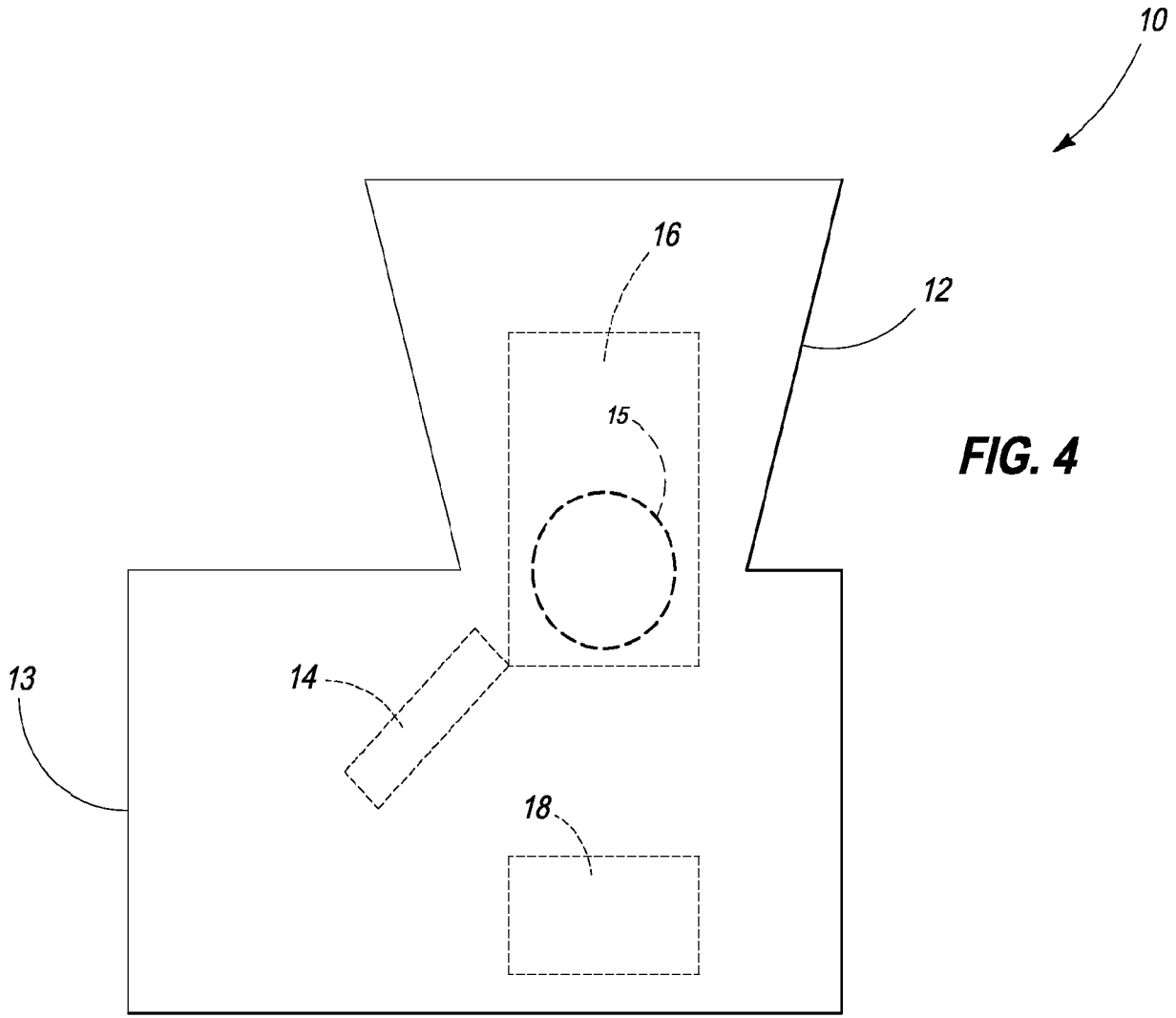
FIG. 4 is another view of the assembly of the present disclosure according to an embodiment.

Referring to FIG. 4, a more detailed depiction of assembly 10 is shown. As described, assembly 10 includes an intake or portal 12 for receiving a ball 15. Within intake or portal 12 can be a subsequent fluid rinse receiving assembly 16 which can be referred to as a rinse stage for example. This rinse stage can be coupled to a fluid outlet which, upon triggering the cleaning sequences, can provide fluid to wash over ball 15 as it rests upon a drain gate which is located at the lower portion of rinse stage 16. This fluid outlet that is coupled to rinse stage 16 can be a conduit that is in fluid communication with a pump 18, which is in fluid communication with a liquid reservoir, with the liquid reservoir holding cleaning solution and/or fluid, for example. Upon application of solution to ball 15, solution passes over ball and through the stage returning to the reservoir configured below stage 16. As the cleaning sequence continues, fluid or cleaning solution from the reservoir ceases being pumped and rinsing over ball 15 and then initiation of a fan 14 provides exhaust air up through the rinse stage, drying and/or ejecting ball 15 out of the top of intake or portal 12.

Pump 18 can be a pump that can be used to provide low to high flows of fluid between the reservoir and the outlet of rinse stage 18, and fan 14 can be a fan that, as configured, provides sufficient air to both dry ball 15 as well as support ball 15 above assembly 10 upon exit from assembly 10. Example pumps include but are not limited to Hydro Pico Evolution Mini Pump and example fans include but are not limited to Sunon Might Mini Fan.

Figure 5:
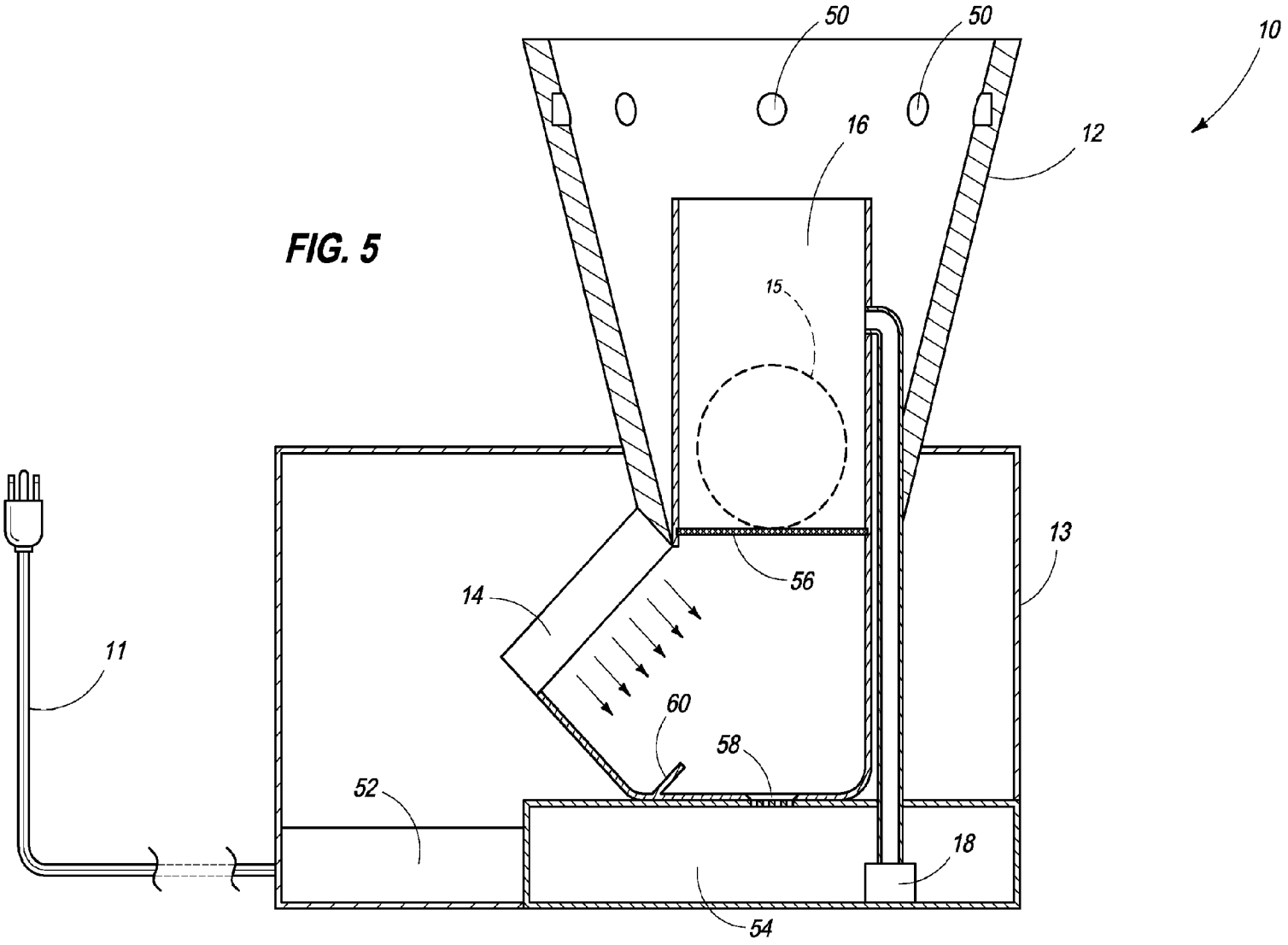
FIG. 5 is yet another view of the assembly of the present disclosure according to an embodiment.

Referring to FIG. 5, a more detailed depiction of assembly 10 is shown that includes motion sensors 50 aligning the top or the upper portion of intake 12. These motion sensors can be in electronic communication with electronic control component 52. Electronic control component 52 can be in electronic communication with pump 18 and fan 14, for example. Electronic control component 52 can be a mini computer, for example, or a hardware computer platform programmed to initiate a sequence of pumping and fan blowing upon activation of motion sensors 50, for example. In accordance with example implementations, upon the initiation of motion sensor 50, pump 18 is triggered to pull cleaning solution from reservoir 54 and provide same to rinsing stage 16. Fluid from reservoir 54 can be pumped over ball 15 in rinsing stage 16 and then allowed to pass through rinsing gate 56, a perforated member sufficient to support ball 15 but insufficient to retain fluid. The fluid then can pass to an opening 58 within assembly 10 below support 56 and return to reservoir 54. After providing a preprogrammed amount of fluid from reservoir 54 to ball 15, pump 18 ceases operation and fan 14 initiates operation at what may include variable rates: a slower operation at first providing simply drying air, and then gradually increasing or triggering to a much higher operation wherein the flow of air ejects ball 15 upwardly out of assembly 10. In accordance with example implementations, the direction of air towards ball 15 can be supported by a flange 60 which directs air current flow away from opening 58 and towards ball 15.

Figure 6:
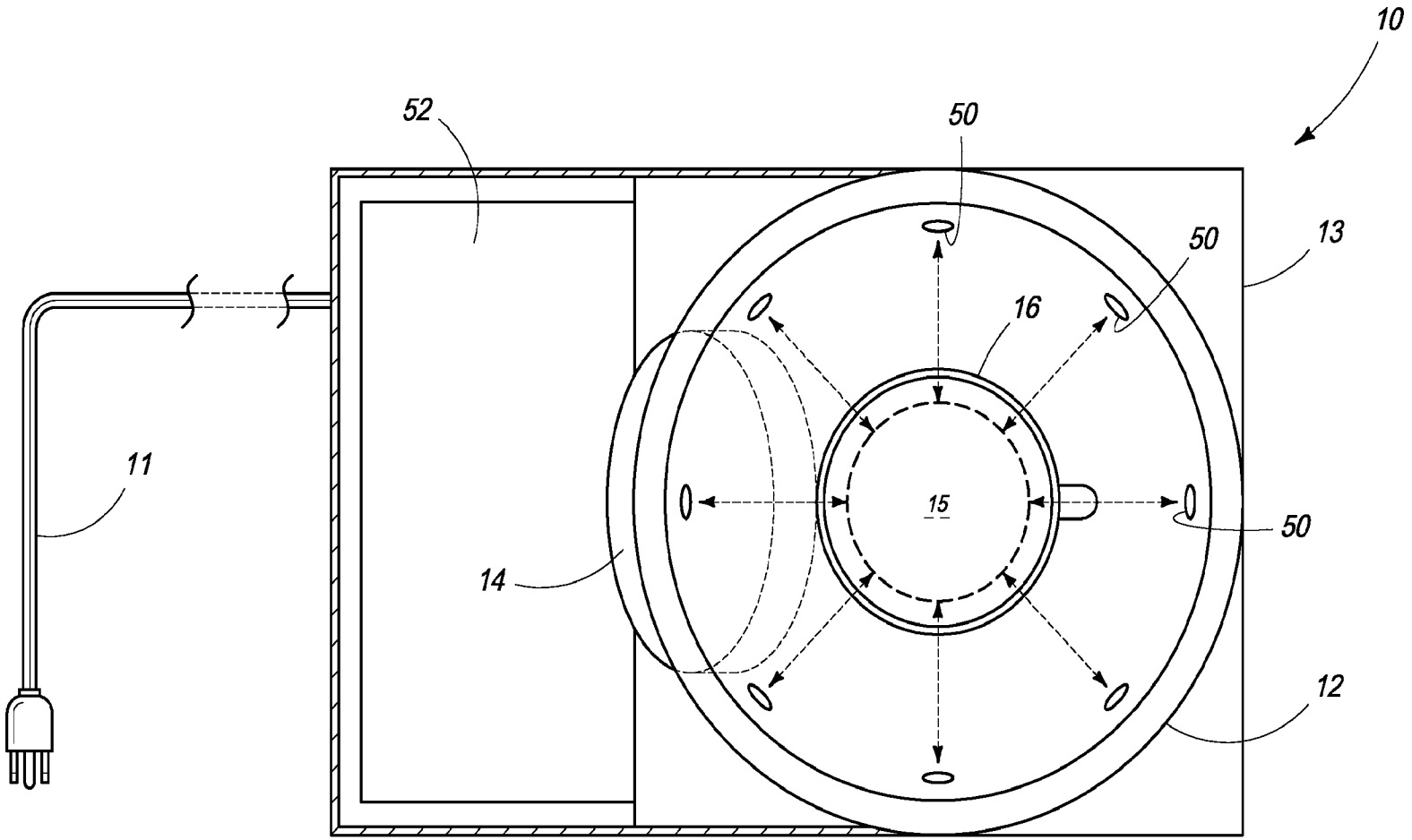
FIG. 6 is yet another view of the assembly of the present disclosure according to an embodiment.

Referring to FIG. 6, a top view of assembly 10 is shown with motion sensor 50 surrounding a periphery of intake 12 and rinsing stage 16 having a ball 15 therein. Electronic control 52 is shown within housing 13. According to example implementations, the entire height of assembly 10 can be approximately 8 inches long; the entire length can be approximately 7½ inches long; and the tank itself can occupy approximately 1 inch of depth of the lower portion of assembly 10.

Figure 7:
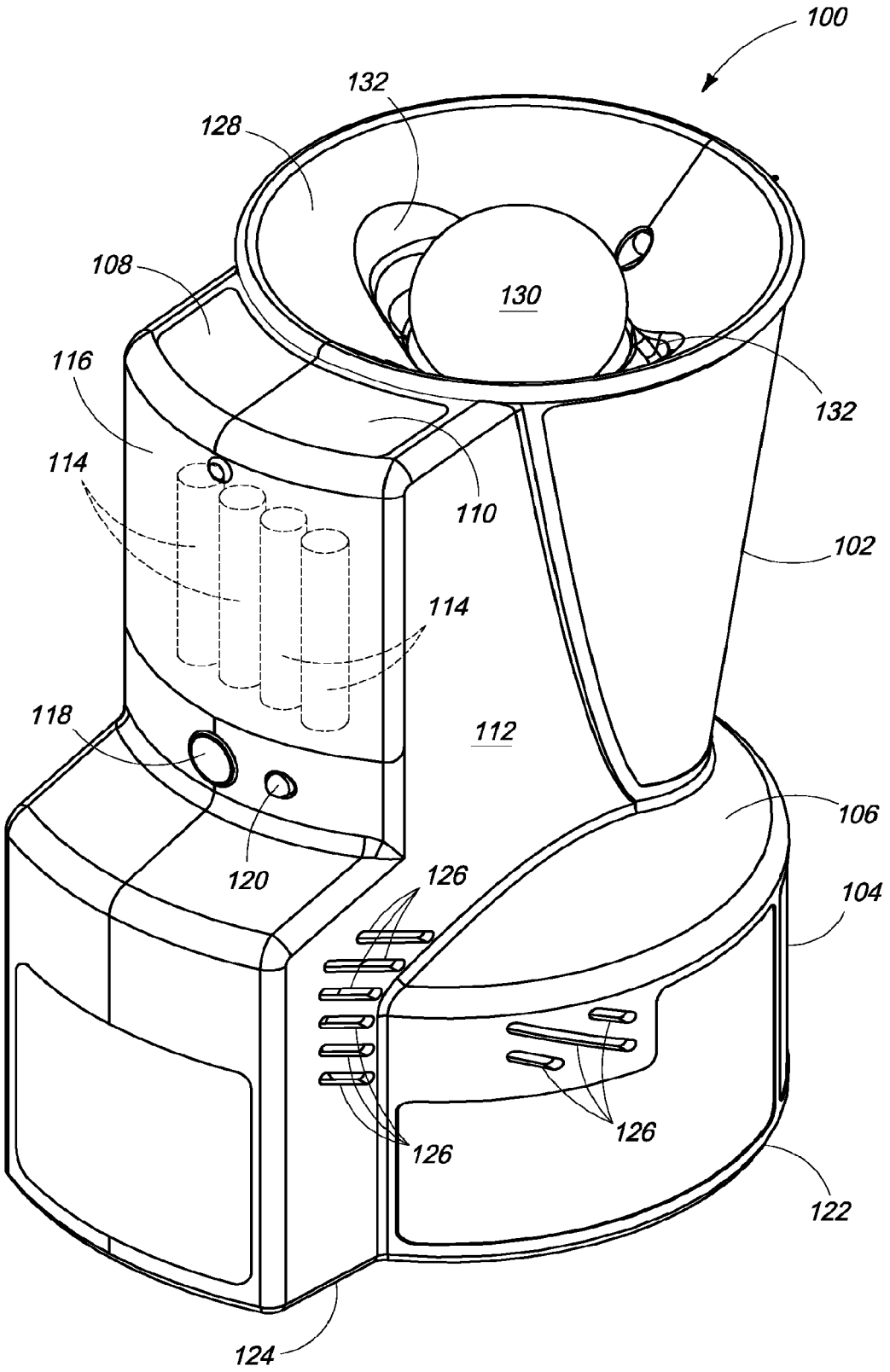
FIG. 7 is an assembly of the present disclosure according to another embodiment.

According to another embodiment of the disclosure, cleaning assembly 100 is provided as shown and depicted in FIGS. 7-12, for example. Referring to FIG. 7, game ball cleaning assembly 100 can include an upper portion 102 and a base portion 104, wherein the upper portion 102 resides above the base portion 104. In accordance with example implementations, the upper portion 102 can be substantially comprised of a cone portion defining a large opening portion descending to a smaller lower portion, wherein the lower portion extends to the base portion via shoulder 106.

As can be seen in FIG. 7, assembly 100 may be parted to include two complimentary portions, a first portion 108 and a second portion 110. By complimentary, these portions may either be fixedly coupled together and/or separated to provide for access to the internal components of these portions.

Upper portion 102 may have a horizontal extension 112 extending therefrom, and this extension may house a power source such as a power source 114. In accordance with example implementations, power source 114 may be configured to house four AA batteries in a substantially vertical orientation. Cover 116 may be placed over power source 114 enclosing same within assembly 100. In accordance with example configurations, assembly 100 may have a start switch 118 as well as a power indicator light 120 as part of this extension as well.

Base 104 may be configured as a semicircular base having a semicircular portion 122 extending to a base extension 124. In accordance with example configurations, base extension 124 may house at least a portion of a fan assembly within assembly 100. In accordance with example configurations, semicircular portion 122 may define a semicircle having a larger radius than the opening of upper portion 102. Assembly 100 may also include vents 126 to provide for air flow to motorized components of assembly 100 such as the rinsing assembly and/or fan assembly.

Referring to upper portion 102 again, configured within upper portion 102 can be interior wall 128 that can be substantially conically formed and configured to receive a ball such as a ping pong ball 130. Recesses 132 may be provided within interior wall 128 to allow for the removal of ping pong ball 130 from assembly 100. In accordance with example configurations, recesses 130 may be configured in a size able to receive digits to allow for the picking up of game ball 130 such as a ping pong ball. In accordance with example configurations, upper portion 102 and the opening thereto may be considered a portal for entry into assembly 100, and this portal may be conically configured as described herein.

Figure 8:
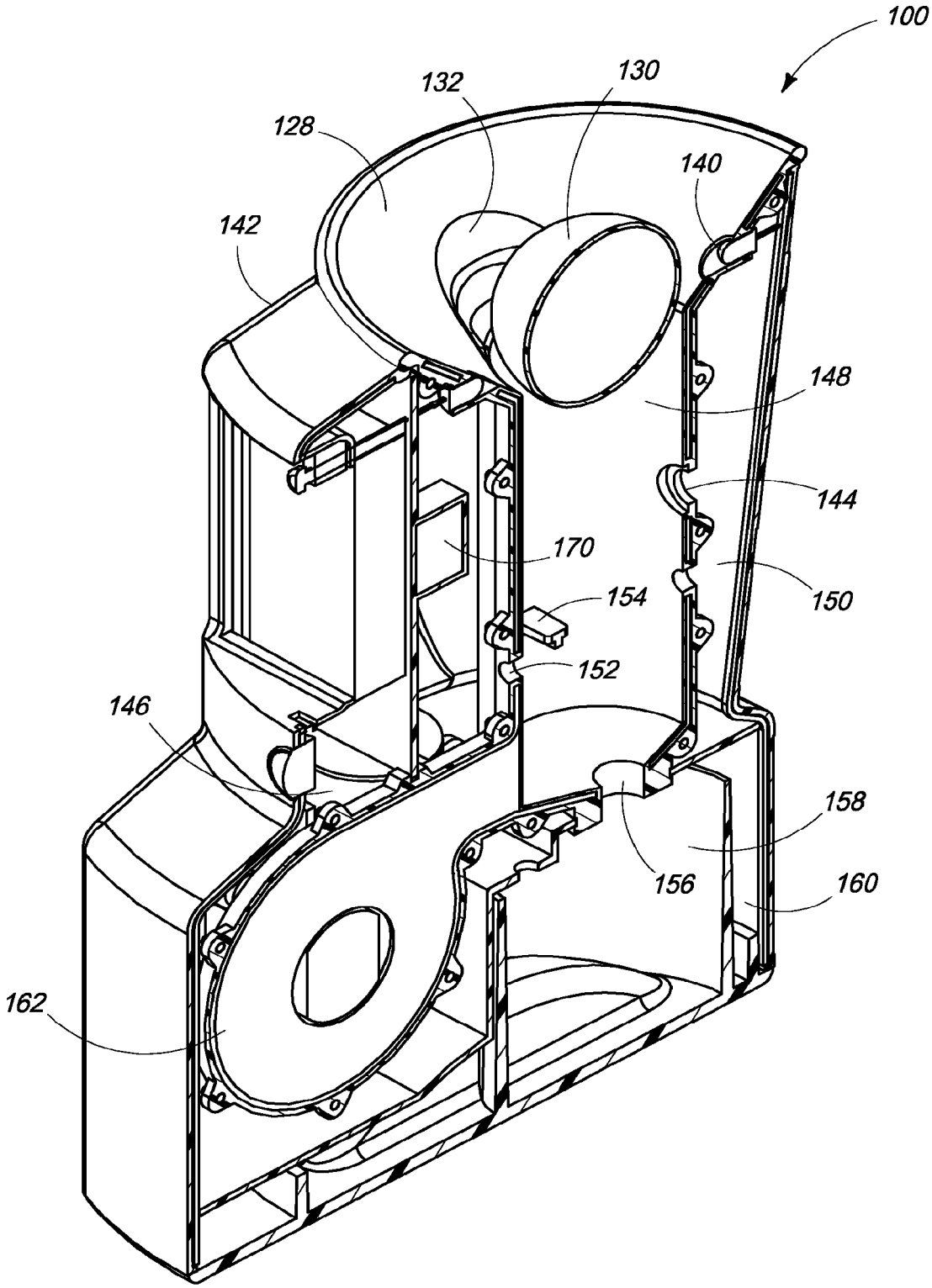
FIG. 8 is a cross section of the assembly of FIG. 7 according to an embodiment of the disclosure.

Referring to FIG. 8, a cross section view of at least one portion of assembly 100 is shown. As is depicted, an emitter 140 and receiver 142 are placed in operational configuration opposing one another within portal defined by walls 128 and configured to sense the presence of an object there between.

Assembly 100 can include a fluid inlet or fluid inlet 144 that can be in fluid communication with a pump 146.

Flowing through a conduit 148 sized to receive ball 130 and aligned therein is fluid inlet 144 as well as operationally configured LED emitter and receiver sensors 150 and 152 configured opposing one another within conduit 148 and configured to sense the presence of an object there between. Extending from conduit 148 can be a member 154 configured to support ball 130 upon receipt within conduit 148. Conduit 148 can terminate in a substantially smaller opening 156 which resides above fluid reservoir 158.

Fluid reservoir 158 can be configured as a reservoir within a reservoir having an outer reservoir 160. This outer reservoir can provide for securing fluid from the remainder of assembly 100 by allowing fluid to be removed or to transfer from reservoir 158 to 160 upon the unintended tipping or falling of assembly 100, for example. In fluid communication with conduit 148 is also fan assembly 162. This can be configured as a squirrel cage fan, for example, having a motor therein and as described earlier, can be housed within a horizontal extension of base 104.

Within assembly 100 can also be printed circuit board 170. This printed circuit board can provide for the control of assembly 100 during operation. In accordance with example configurations, the printed circuit board can provide for initiation upon power turned off and on, and upon initiation of power on, sensors are configured wherein once sensors 150 and 152 detect a ball therein, a predefined cascade of events between the pump and fan functions are initiated.

For example, upon sensing of a ball between sensors 150 and 152, fluid is provided from reservoir 158 via pump 146 through tubing to opening 144 and to within conduit 148. The fluid is then allowed to cascade over ball 130 and return to reservoir 158. This cascading and pumping can be provided for a certain amount of time. Example lengths of time can include but are not limited to 3 seconds. Upon completion of this amount of time, pumping can be ceased, and a certain amount of time can be exhausted to allow fluid to drain from conduit 148 and/or ball 130. Upon this draining time, the fan can be initiated, providing exhaust to within conduit 148 from fan assembly 162, projecting ball 130 to within the portal defined by surface 128. The ball then is sensed by emitters 140 and 142, and upon the sensing of the ball being removed from the portal, the circuit board returns assembly 100 to its initiation state, waiting once again for the sensing of a ball at sensors 150 and 152, for example.

Figure 9:
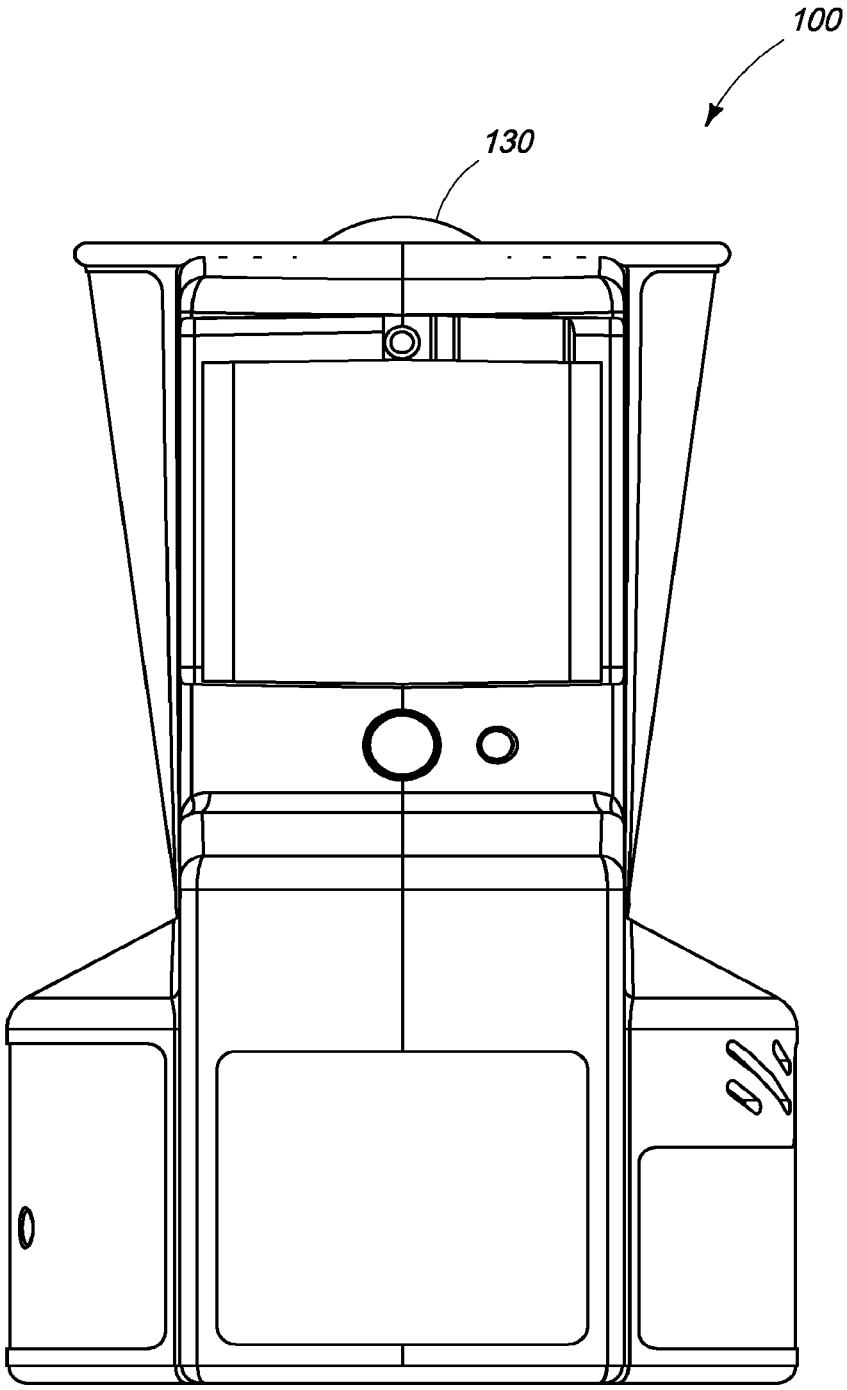
FIG. 9 is another view of the assembly of FIG. 7 according to an embodiment of the disclosure.
Figure 10:
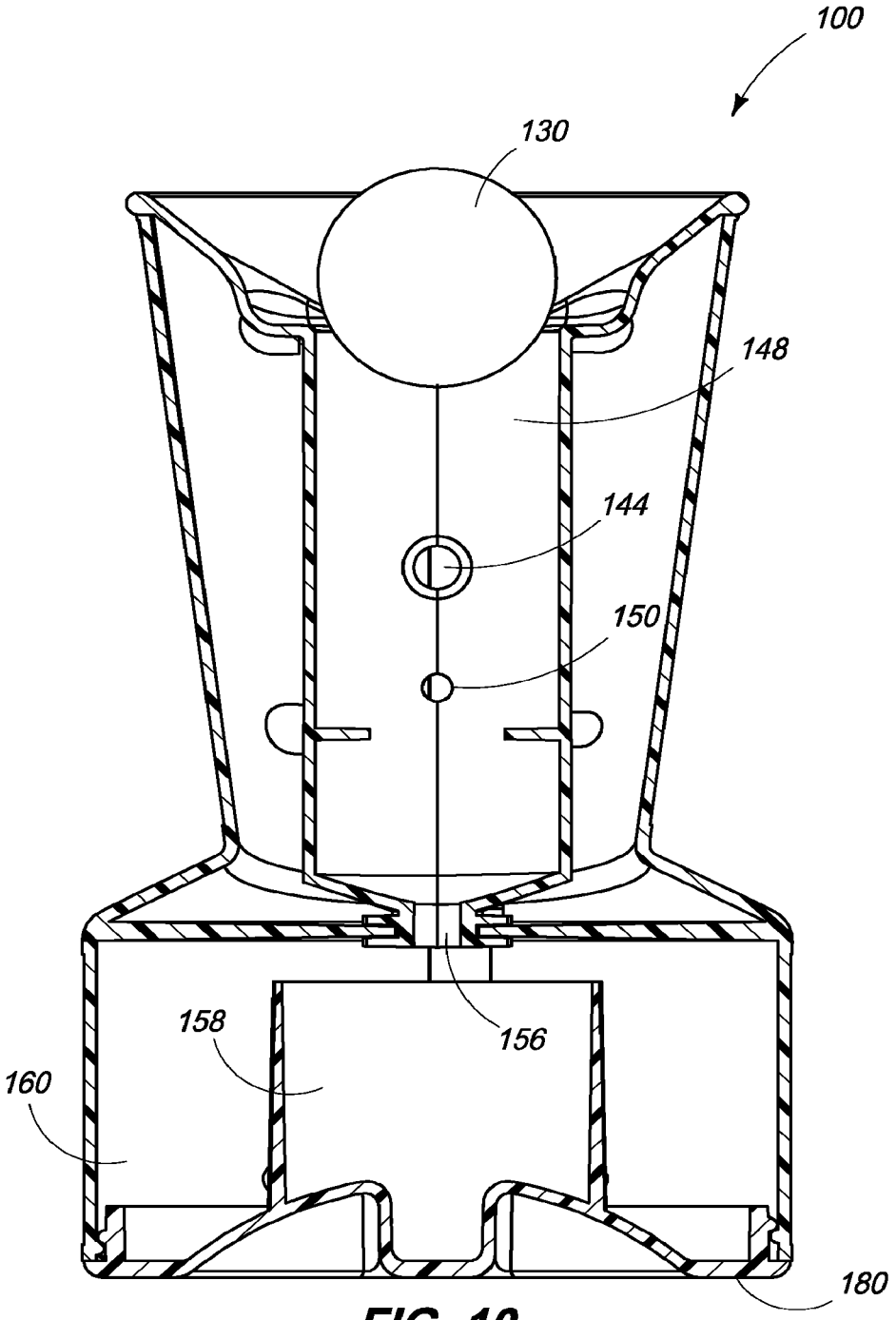
FIG. 10 is a cross sectional view of the assembly of FIG. 7 according to an embodiment of the disclosure.

Referring to FIG. 9, another view of assembly 100 is shown. This is the rear view. Referring to FIG. 10, at least a partial cross section of assembly 100 is shown, demonstrating the fluid opening 144 as well as sensor 150. As can be seen, opening 156 provides fluid communication between conduit 148 and reservoir 158. As can also be seen, reservoir 158 is bounded by secondary reservoirs 160. The reservoir 158 and the sidewalls thereto can form a removable base component 180. This base component 180 can be removed from portions 108 and 110 (as shown in FIG. 7) through, for example, a screw coupling mechanism that allows for the base component 180 to be fixedly attached to assembly 110 and also provide for the removal of the fluid reservoir for cleaning and/or maintenance as needed.

Figure 11:
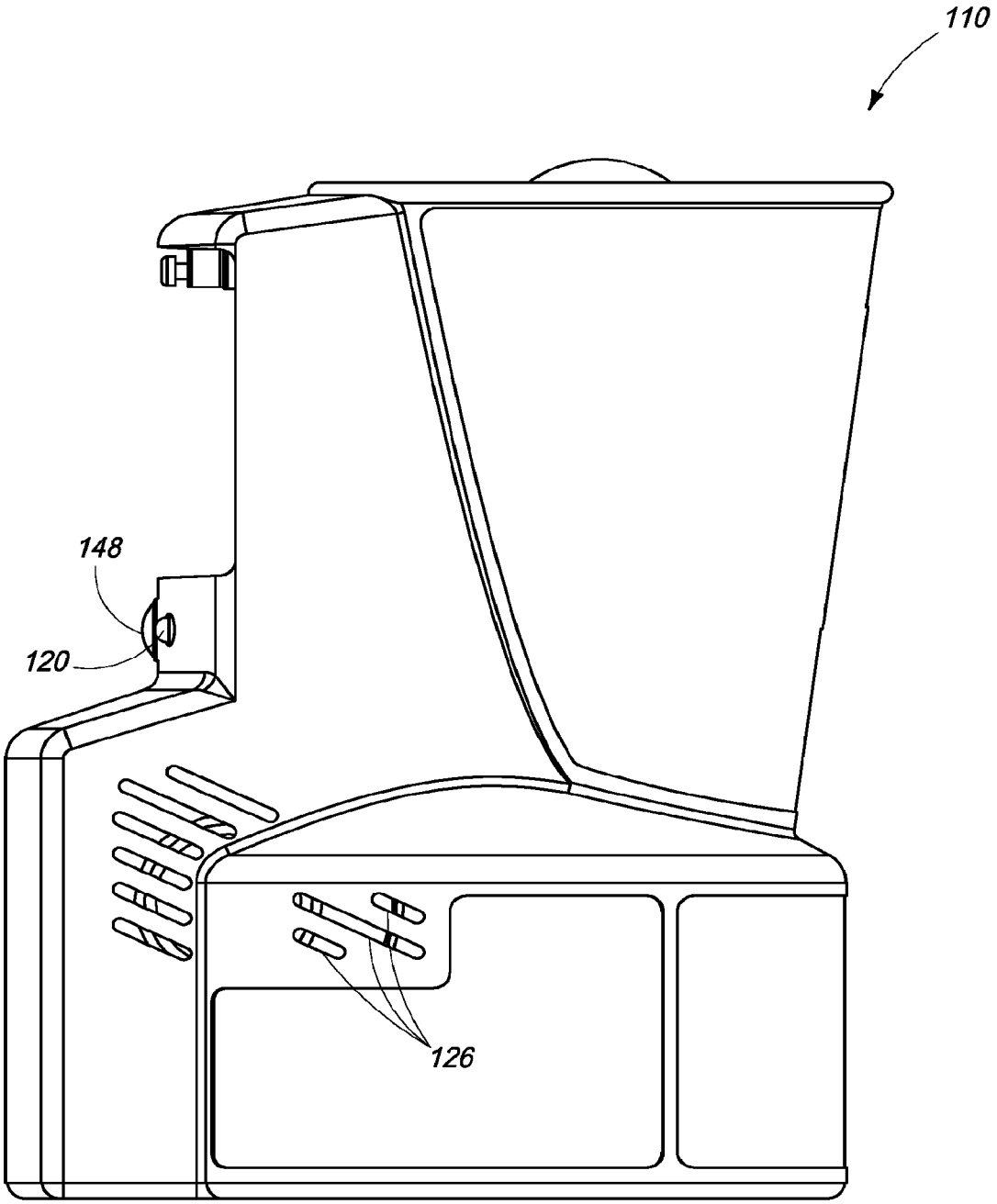
FIG. 11 is a side view of the assembly of FIG. 7 according to an embodiment of the disclosure.
Figure 12:
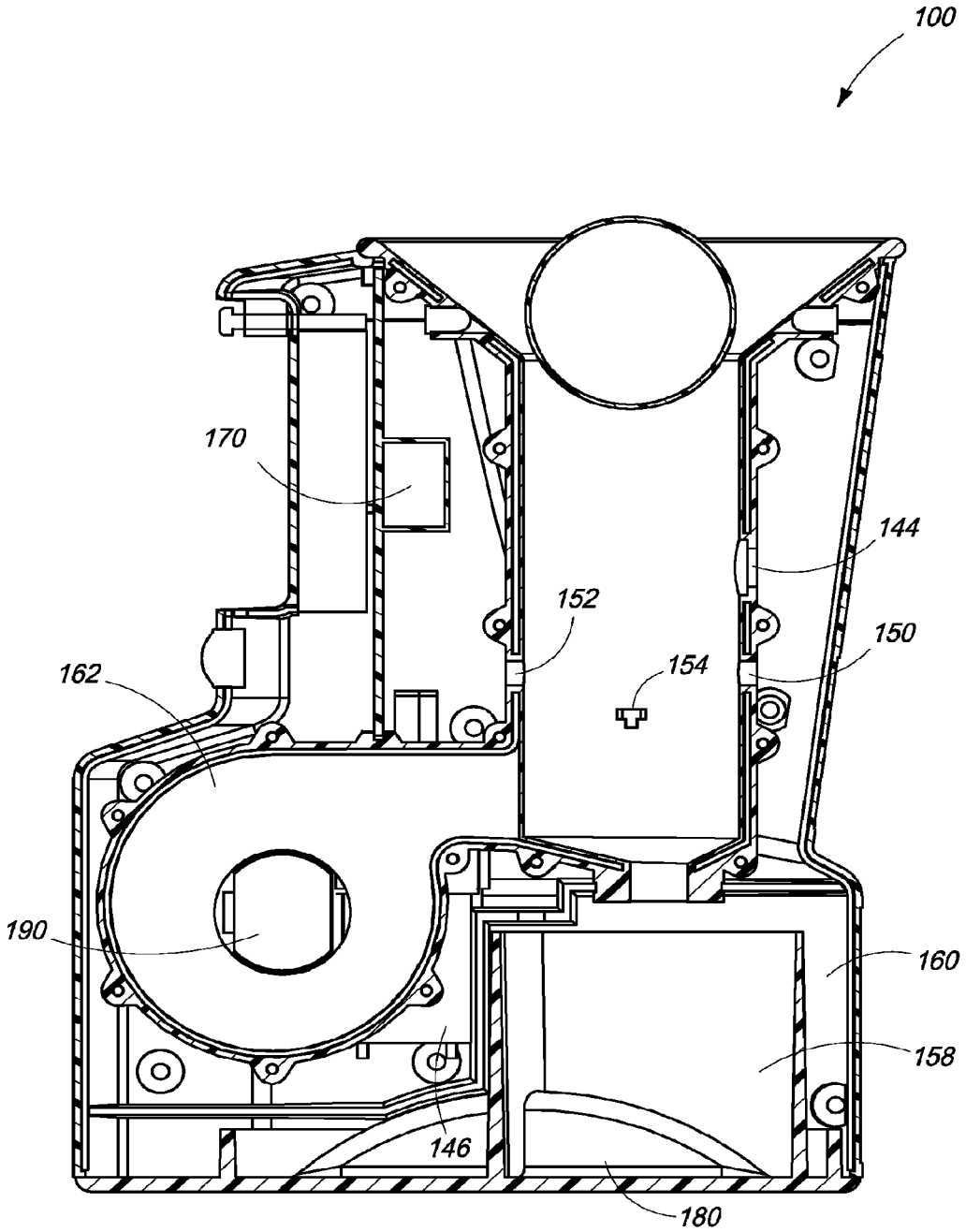
FIG. 12 is a cross section of the assembly of FIG. 7 according to an embodiment of the disclosure.

Referring to FIGS. 11 and 12, a side view which is complimentary to another side view of assembly 110 is shown, as well as a cutout view in FIG. 12. In accordance with example configurations, as can be seen, assembly 180 is coupled with at least a portion of assembly 100. Fan assembly 162 includes motor 190 and reservoir 158 is shown with boundary reservoir 160. In accordance with example configurations and as shown herein, the assembly can include ball sensors associated with the portal in prior fluid communication and the rinsing assembly or fan assembly that is included within assembly 100.

These ball sensors can include a light sensor projecting substantially normal to the interior surface of the portal, but in some circumstances, they can be at an angle because the portal is conically shaped. The ball sensor can be in fluid communication with at least one or both of the rinsing assembly and/or fan assemblies as shown in figures herein, and the rinsing assembly can include a game ball dock that is shown, for example, as member 154. This game ball dock may be just a projection from within conduit 148, but also may include sidewalls and a perforated platform, for example, and be configured to allow for fluid to transfer thereby.

Conduit 148 can be an example of a conduit establishing fluid communication between the game ball dock and the fluid reservoir. A pump can be provided herein as shown that can be configured to convey fluid from the reservoir via the conduit to the dock and the pump can be in electronic communication with the game ball sensor via, for example, the printed circuit board and/or the power assembly. According to example implementations, the fan assembly exhaust can be configured to exit the game ball from the portal. In accordance with the embodiments shown, the fan assembly can be lateral of the game ball portal and/or lateral of the fluid reservoir.

In accordance with example configurations, the game ball cleaning method of the present disclosure can be configured to provide a game ball to a portal, such as the portal defined in the embodiments shown in the figures; then the method can include electronically initiating a cleaning sequence for the game ball. This cleaning sequence can be hard programmed into a printed circuit board, for example. The cleaning sequence can be as described herein, and then returning the game ball to the portal through which it was received. The game ball cleaning method can also include exposing the game ball to a fluid within an assembly and/or depositing the fluid over at least an upper surface of the game ball. Fluid may also pass over the game ball and return to a reservoir. The sequence may also include providing fan exhaust through the portal, with the exhaust returning the game ball to the portal. In accordance with example implementations, the exhaust can also at least partially remove fluid from the game ball. In accordance with many example embodiments described herein, the game ball may be a ping pong ball, but other balls are contemplated.

Figure 13:
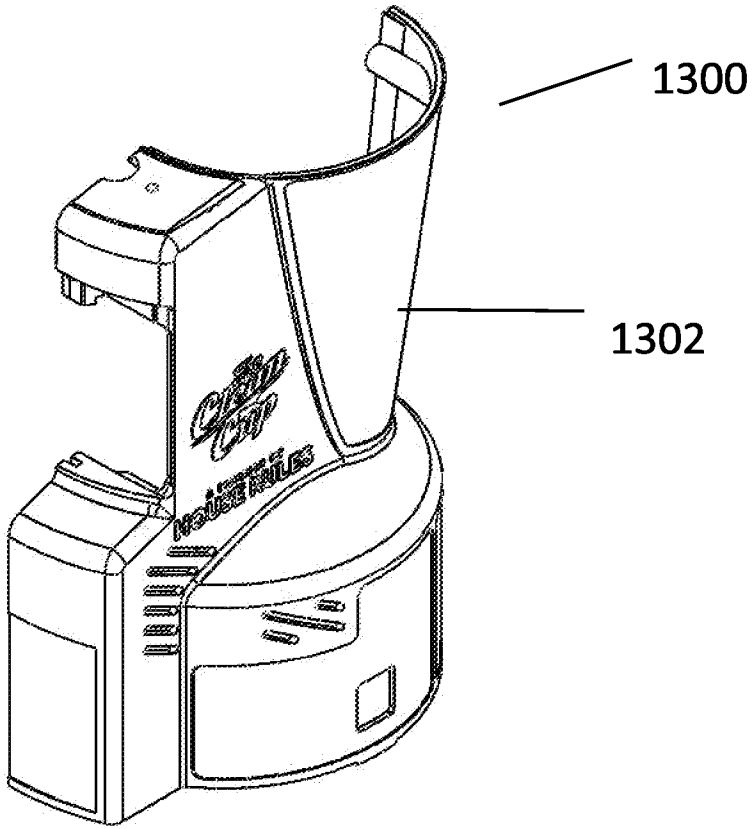
FIG. 13 is a perspective view of the first right side of the outer shell housing of an alternative embodiment of the disclosure.
Figure 14:
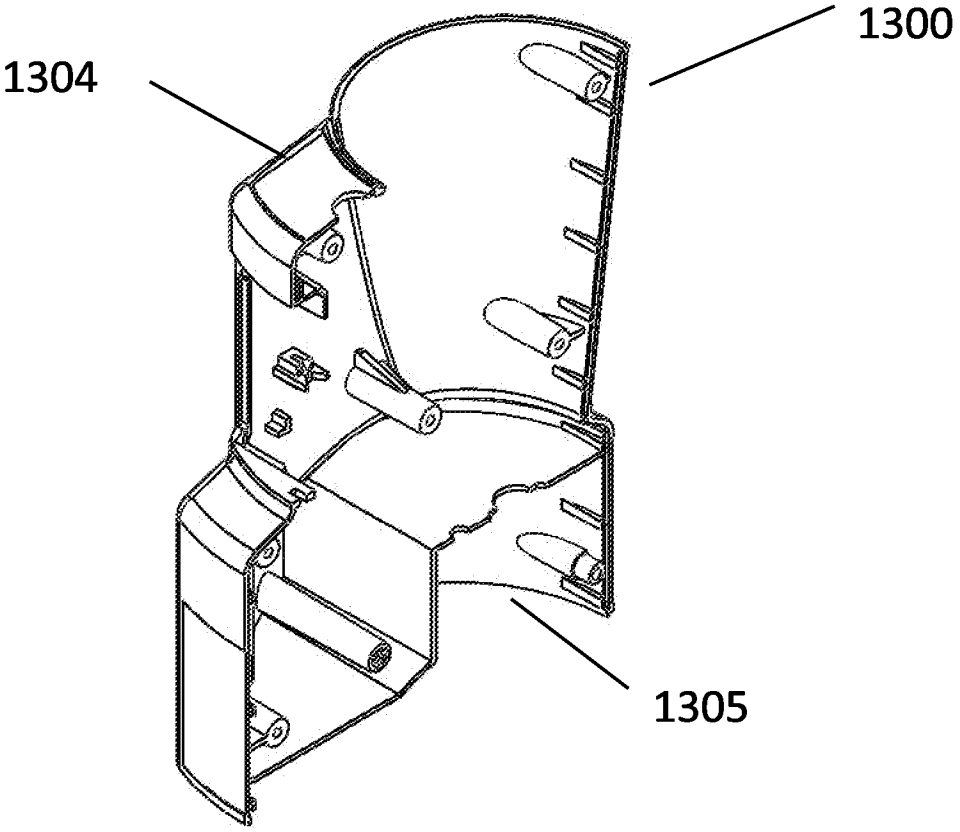
FIG. 14 is a perspective view of the second left side of the outer shell housing of the alternative embodiment of the disclosure.
Figure 15:
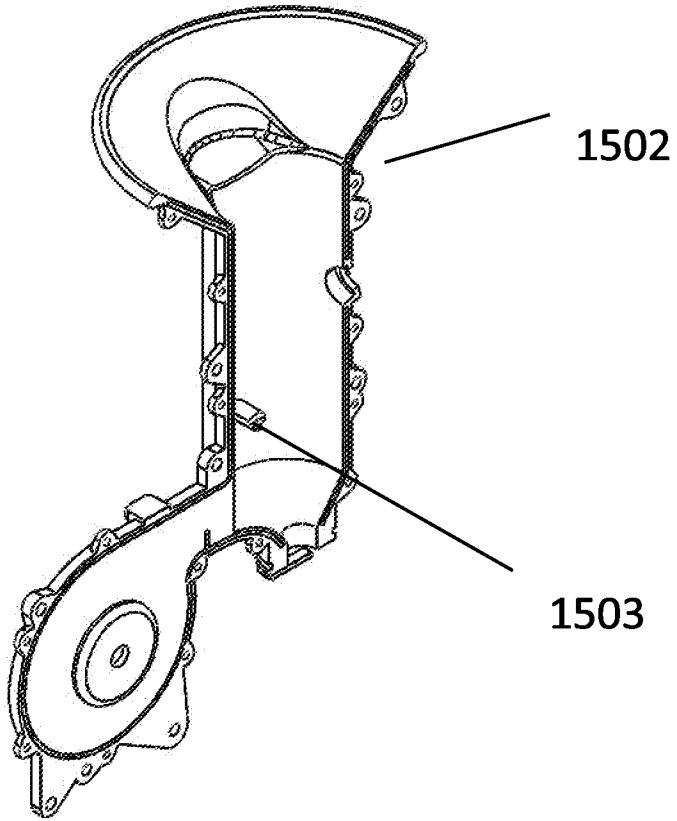
FIG. 15 is a perspective view of the first left piece of the inner shell housing of the alternative embodiment of the disclosure.
Figure 16:
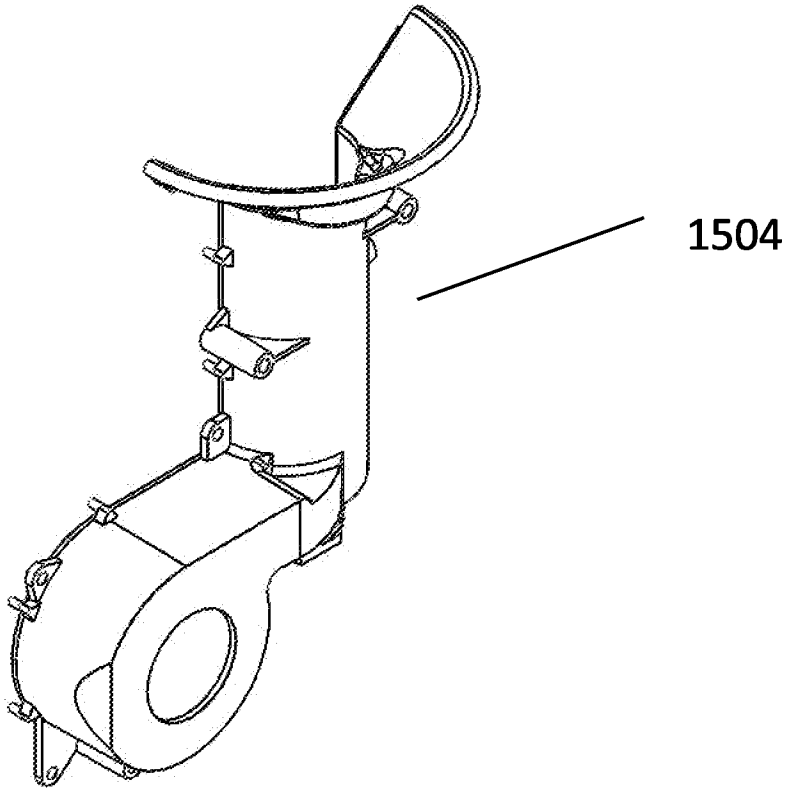
FIG. 16 is a perspective view of the second right piece of the inner shell housing of the alternative embodiment of the disclosure.
Figure 23:
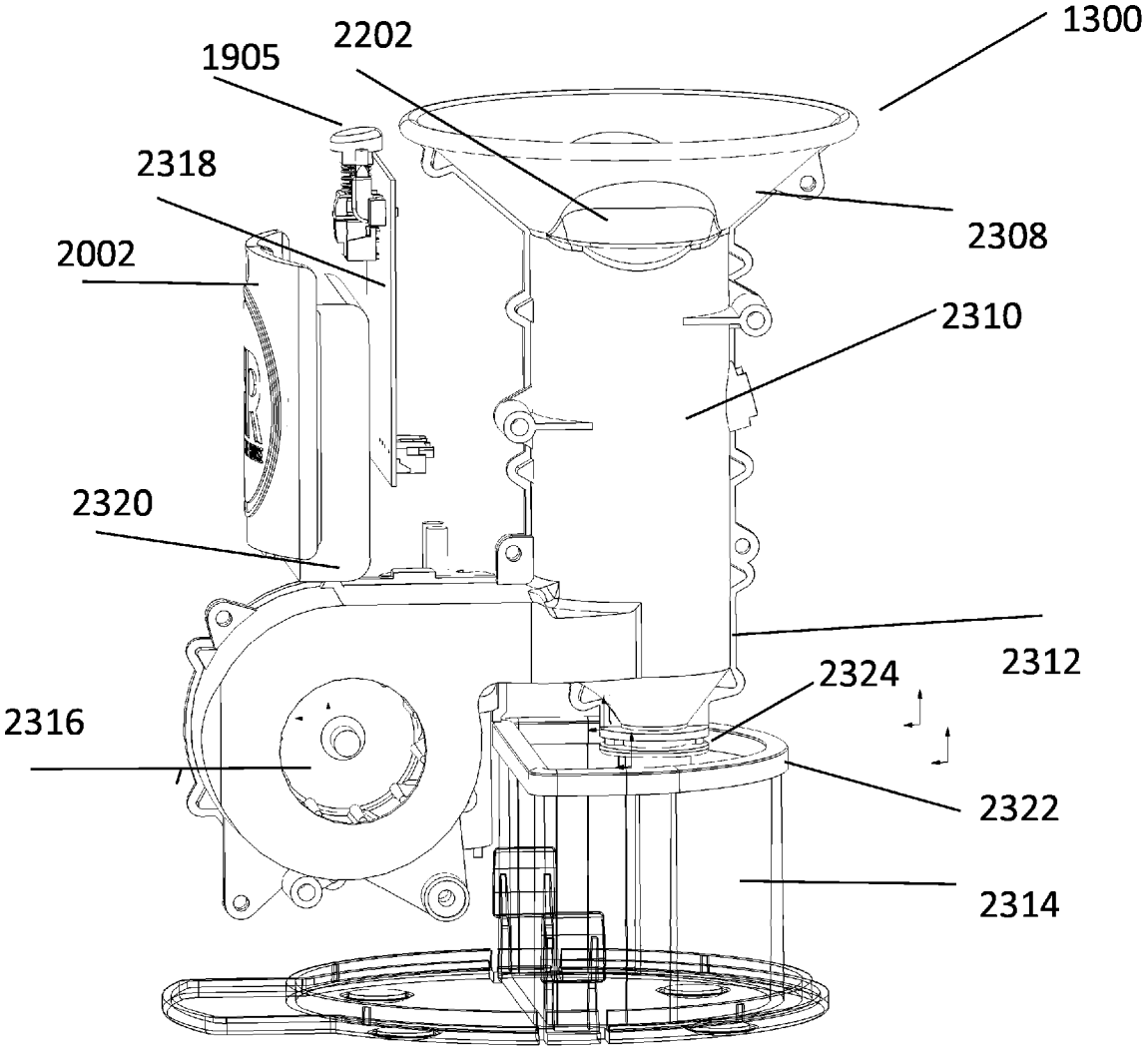
FIG. 23 is a perspective view of the inner components of the alternative embodiment of the disclosure.

In an alternative embodiment of the present application, and as shown in FIG. 13, the game ball cleaning device 1300 includes an outer shell including a first right side 1302 and as shown in FIG. 14, a second left side 1304 which are connected to protect the inner shell housing components and inner mechanisms of the device. The first side is configured to align with the second side. Once aligned, the first side 1302 and the second side 1304 form a recess 1305 where a reservoir 2314 (as shown in FIG. 23) of fluid is located. As shown in FIG. 15, the inner shell housing includes a first left piece 1502 and as shown in FIG. 16, a second right piece 1504. The first left piece 1502 is configured to align with the second right piece 1504. The first left piece 1502 further includes an extruding peg 1503 for holding a game ball in place while the game ball is being rinsed. The second right piece 1504 also includes an opposing extruding peg (not shown) for holding the game ball. In another embodiment of the present application, the opposing pegs may be located in any position within the inner shell housing pieces. As will be further described in FIG. 23, the connected inner shell housing pieces 1502, 1504 are configured to connect to form a funnel 2308 for receiving a game ball and further configured to form an elongated chute 2310 where the game ball is transported. The device 1300 includes a fan 2316 which is located within the connected inner shell housing pieces 1502, 1504 and which is in communication with the elongated chute 2310. The device 1300 includes a pump (not shown) which is located within the reservoir 2314 and in fluid communication with the elongated chute. A power control board 2318 controls the fan 2316 and the pump to deliver an air and fluid mixture over the game ball.

Figure 17:
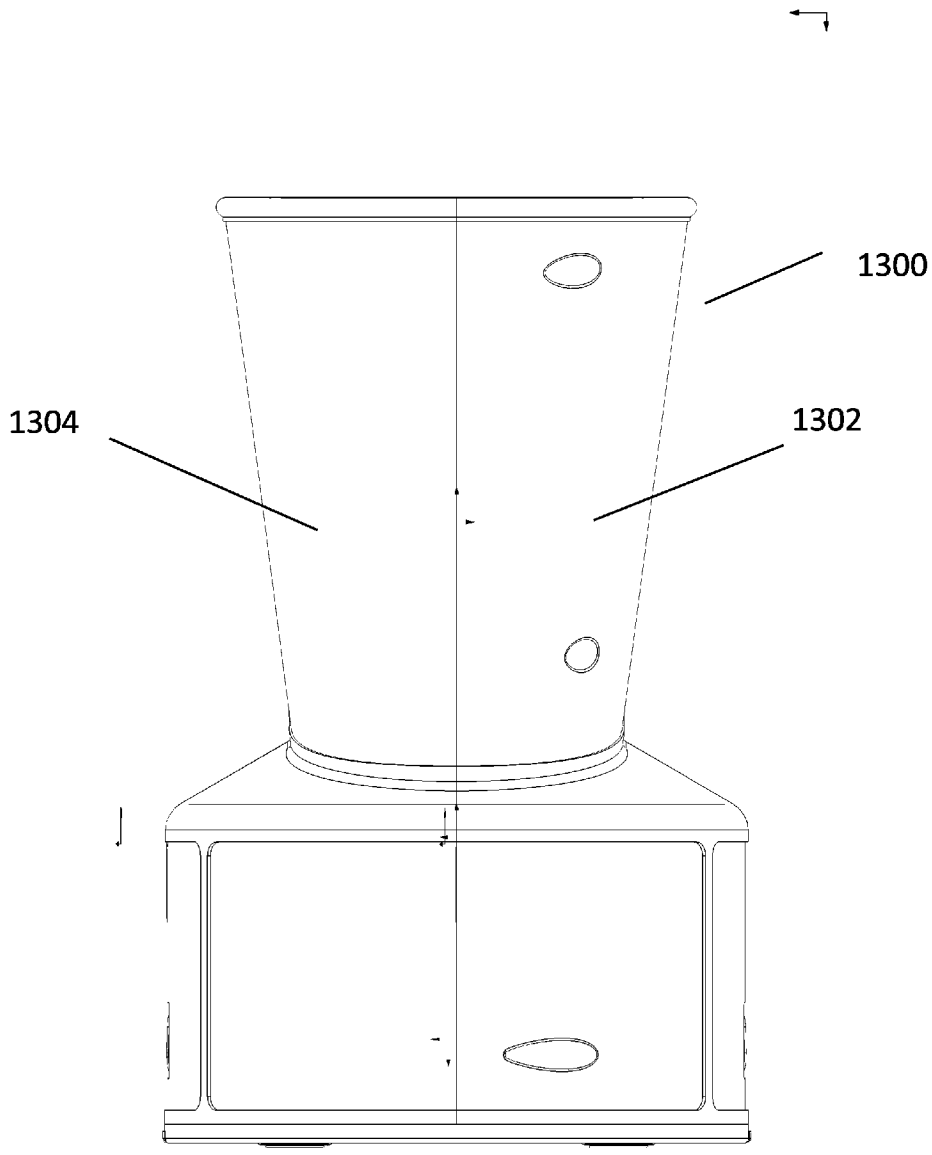
FIG. 17 is a rear view of the alternative embodiment of the disclosure.
Figure 18:
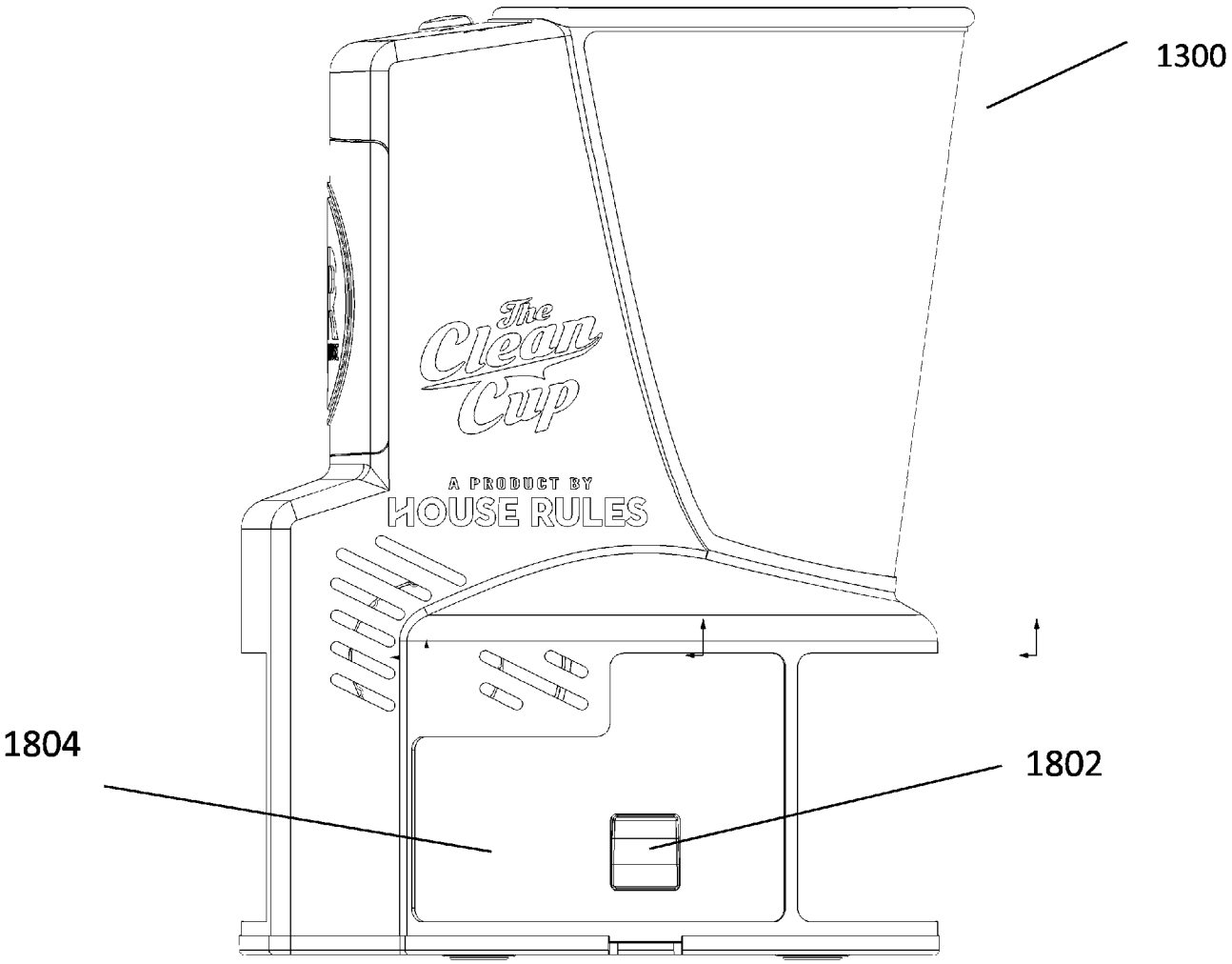
FIG. 18 is a left side view of the alternative embodiment of the disclosure.
Figure 19:
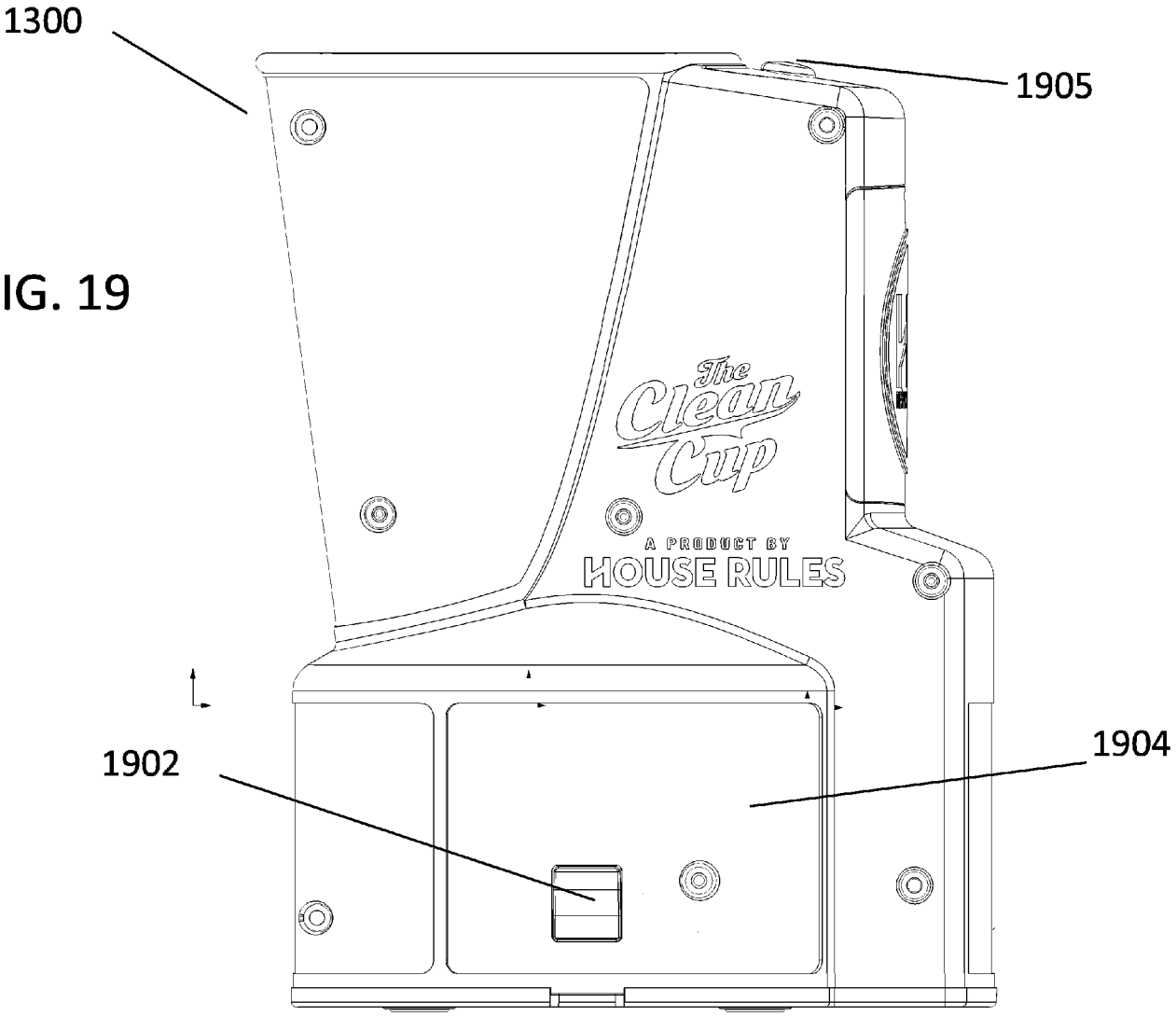
FIG. 19 is a right side view of the alternative embodiment of the disclosure.
Figure 20:
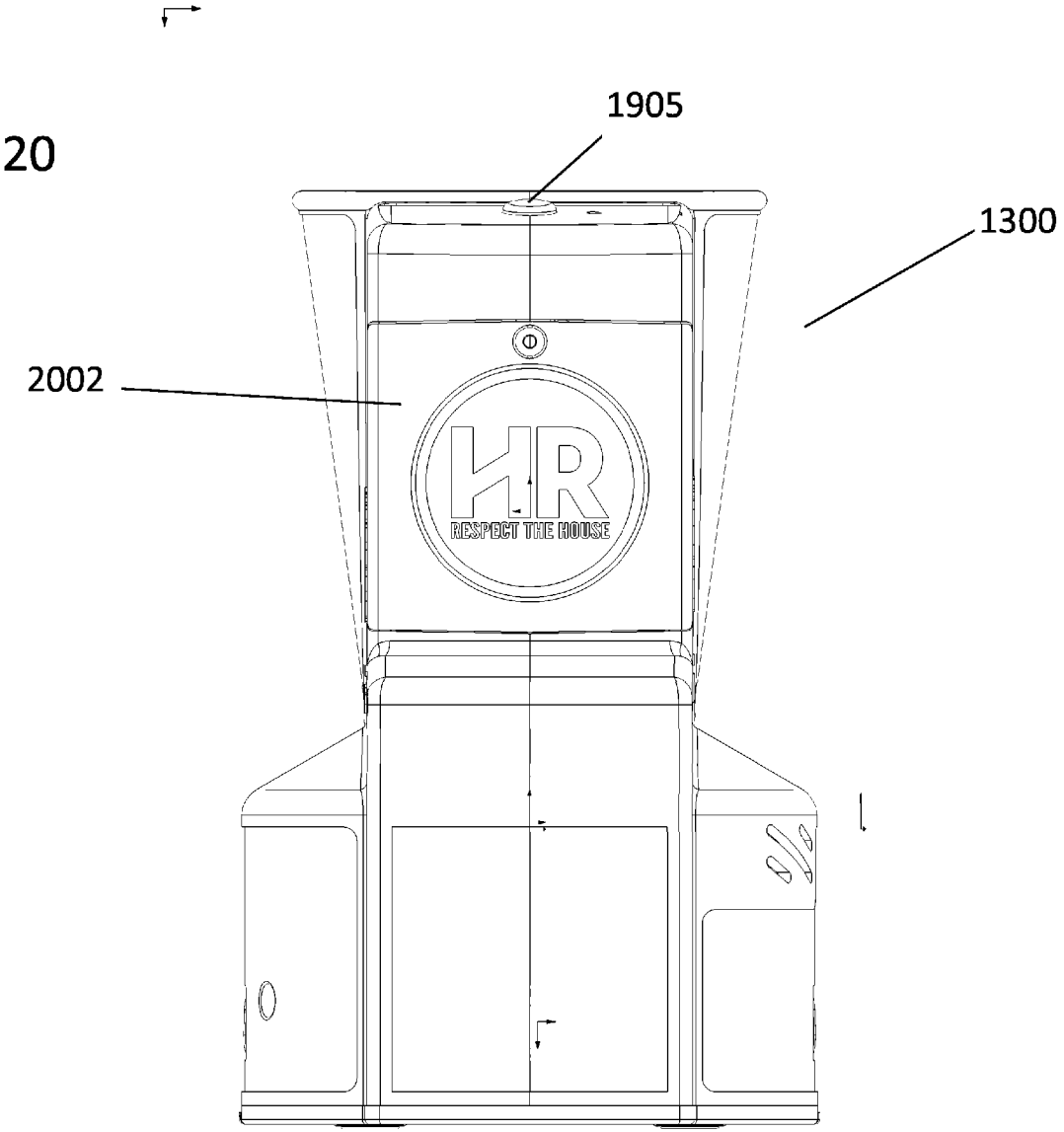
FIG. 20 is a front view of the alternative embodiment of the disclosure.

FIG. 17 shows the rear view of the device 1300 with the first side 1302 and the second side 1304 of the outer shell housing fully connected. FIG. 18 shows the right side view of the device 1300. FIG. 19 shows the left side view of the device 1300. FIG. 20 shows the front facing view of the device 1300. As shown in FIG. 18, each outer shell side includes a depression 1802 and 1902 (as shown in FIG. 19) which controls the removal of a reservoir or tank 1804 and 1904 (as shown in FIG. 19). The reservoir 1804, 1904 is where fluid is contained that is used to rinse the game ball. The reservoir can only be removed when both depressions 1802, 1902 are simultaneously inwardly pressed. Removal of the reservoir allows the player or user to pour out any fluid that has been used to rinse the game ball and refill the reservoir with new rinse fluid. The wash/rinse cycle of the device is initiated by pressing an initiation button 1905.

Figure 21:
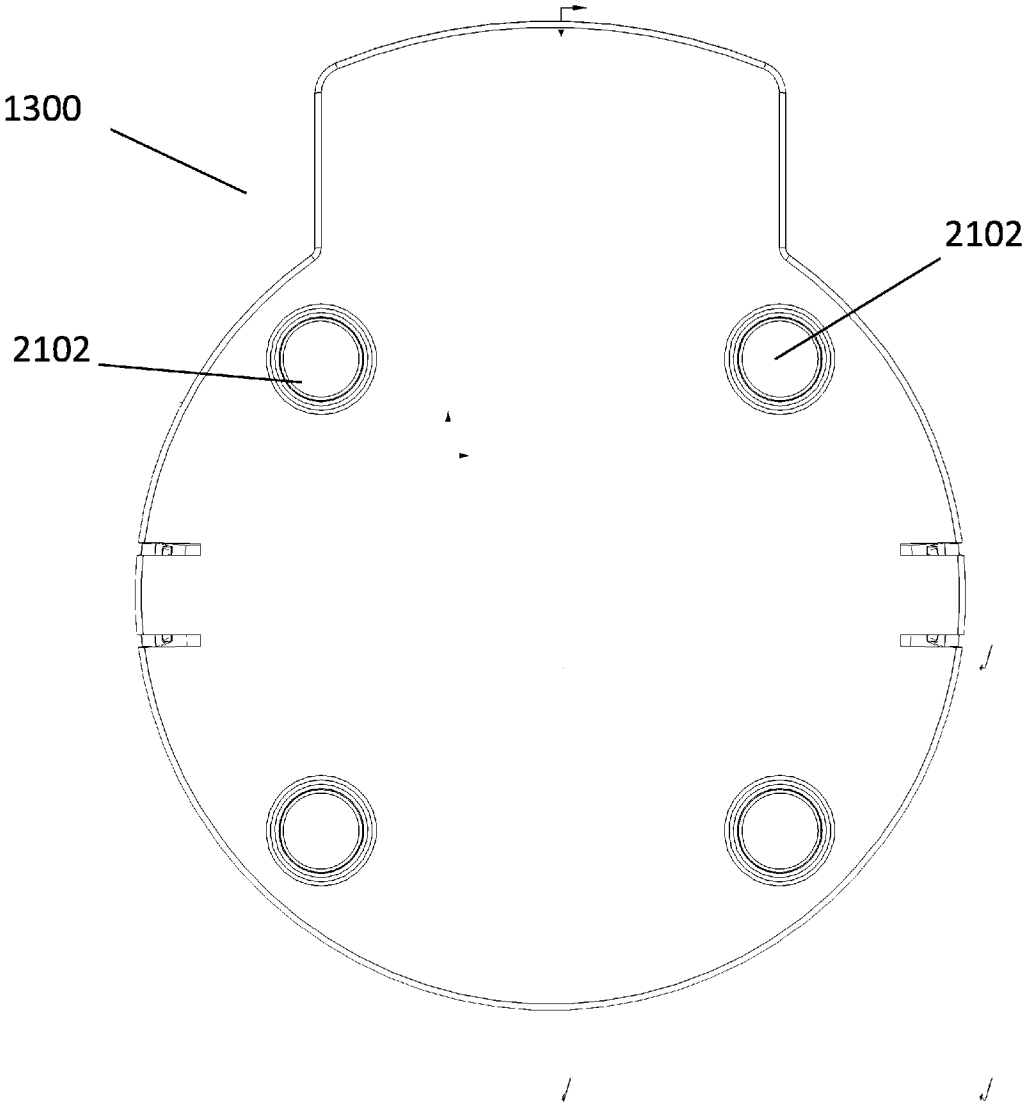
FIG. 21 is a bottom view of the alternative embodiment of the disclosure.

The device is designed such that the outer shell pieces when connected form indents in a variety of geometric shapes which are able to receive stickers for enhanced decoration and advertisement. The device may be battery operated. As shown in FIG. 20, the batteries are held behind a battery door 2002. Above the battery door 2002 is the initiation or on/off button 1905 of the device 1300. As shown in FIG. 21, the bottom of the device 1300 contains rubber support foots 2102. The rubber supports 2102 ensure that the device 1300 is stationary on any surface it is placed upon.

Figure 22:
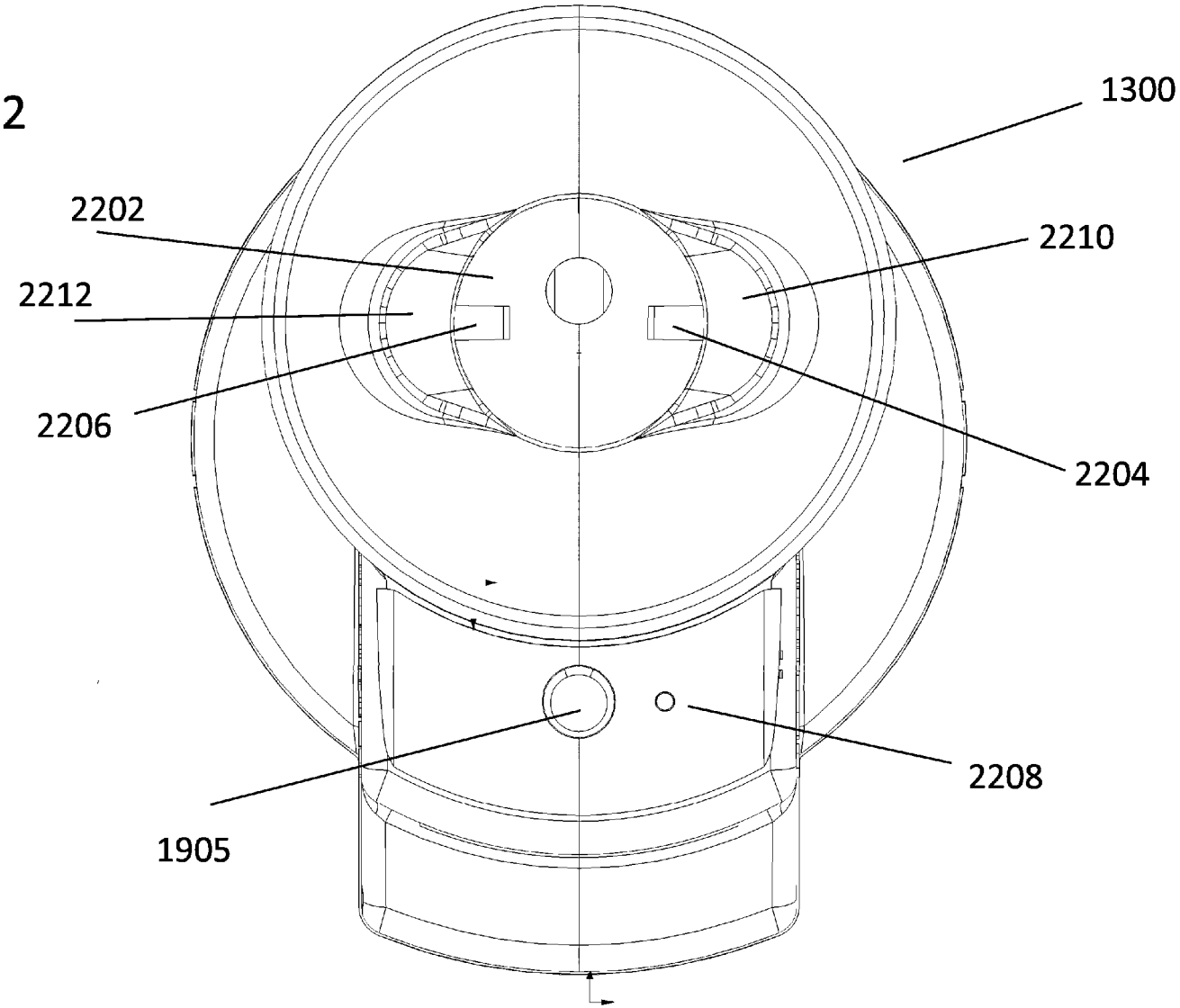
FIG. 22 is a top view of the alternative embodiment of the disclosure.

FIG. 22 shows the top view of the device 1300. FIG. 23 shows the inner components of the device 1300. A game ball is placed or dropped into a circular slot 2202 and onto the opposing pegs 2204, 2206 which are located within the inner shell housing connected pieces. The opposing pegs 2204, 2206 support the game ball and hold the game ball in position for when the initiation button is depressed and the wash/rinse cleaning cycle begins. As shown in FIG. 23, the circular slot 2202 is positioned in the center of a funnel shape piece 2308. Once the user depresses the initiating button 1905, the opposing pegs 2204, 2206 are lowered causing the game ball to travel to the bottom portion of the elongated chute 2310 (as shown in FIG. 23) where it is rinsed with a mixture of air and fluid. The initiating button commences the cleaning sequence of the air and fluid mixture. The air is created by the motorized impeller/fan 2316 which is in communication with the elongated chute 2310. The fluid is delivered from the reservoir 2314 via a pump (not shown) which is in fluid communication with the elongated chute 2310. After the cleaning process is complete, a final jet of air from the impeller/fan 2316 causes the game ball to be propelled up through the elongated chute 2310 and returned to the circular slot 2202 where the game ball was initially inserted. The game ball will appear to be floating over the circular slot 2202 at which point the game ball is then captured and removed by a player by inserting their fingers into the opposing depressions 2210, 2212 (as shown in FIG. 22) within the circular slot 2202. In the event the game ball is not pulled away from the circular slot 2202 within the programmed time, the game ball will fall back into the elongated chute 2310 and onto the opposing pegs 2204, 2206 where the cleaning sequence may be repeated. As shown in FIG. 22, an LED indicator light 2208 illuminates a color (such as blue) when the cleaning sequence is underway. After a preprogrammed amount of time, the cleaning sequence will cease to operate. In another embodiment, an additional button may be located on the device which would directly control the fan to produce additional jets of air sufficient to eject the game ball to the circular slot for a longer period of time, thereby allowing a player a longer period of time to capture the game ball. This would avoid the game ball from falling back into the elongated chute.

As illustrated in FIG. 23, any debris rinsed off the game ball falls through a mesh filter 2324 and into the reservoir 2314 where the rinse fluid is stored. The mesh filter 2324 rests at the bottom portion 2312 of the chute 2310 and rests on channels designed to hold it in place. The mesh filter 2324 captures any large debris on the game ball and ensures that such debris does not fall into the reservoir 2314 after rinsing has occurred. This allows for a clean game ball to be returned to a player. The mesh filter 2324 is removable and cleanable at any time during game play and after as many uses as desired. The reservoir 2314 is sealed by a fluid leak prevention gasket 2322. The gasket 2322 covering prevents leakage or spillage of fluid during the rinsing/cleaning stage. The gasket 2322 also prevents any fluid and/or debris from leaking out of the elongated chute 2310 or reservoir 2314. The reservoir 2314 is filled with fluid that may or may not contain a cleaning solution. In another embodiment, the reservoir 2314 of the device 1300 may contain a mixture of fluid with abrasive cleaning solutions.

Figure 24:
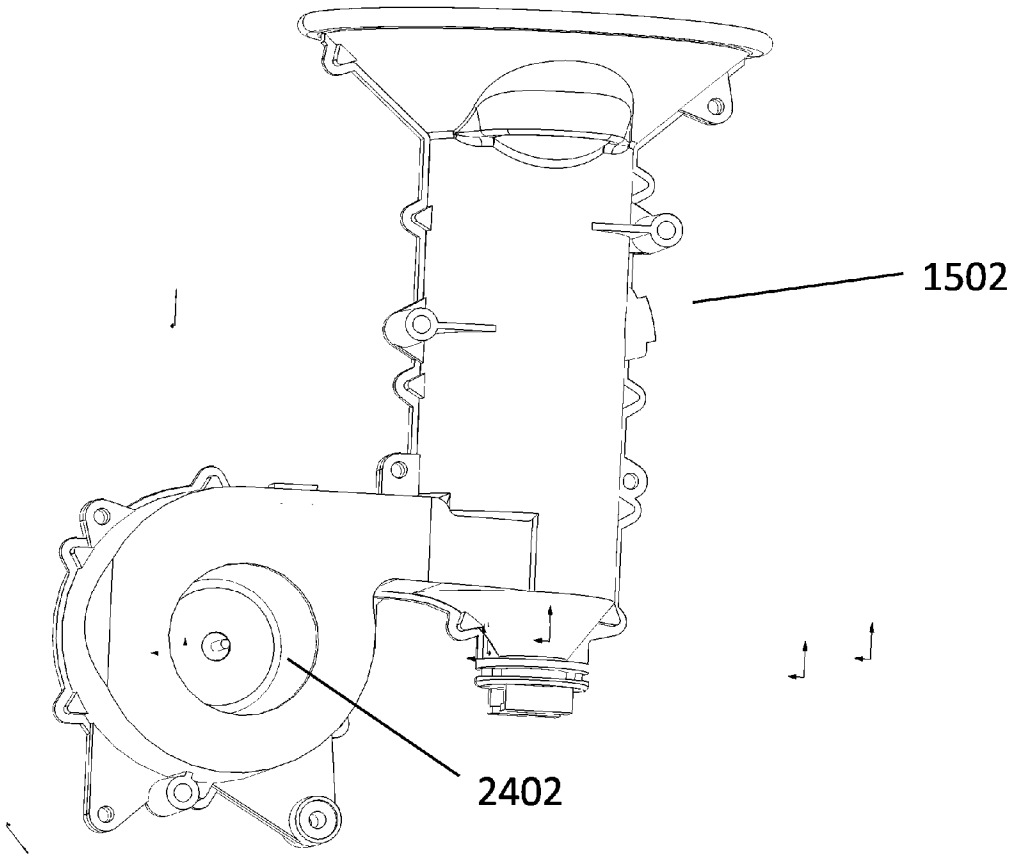
FIG. 24 is an alternative of the right side view of the inner shell housing of the alternative embodiment of the disclosure.
Figure 25:
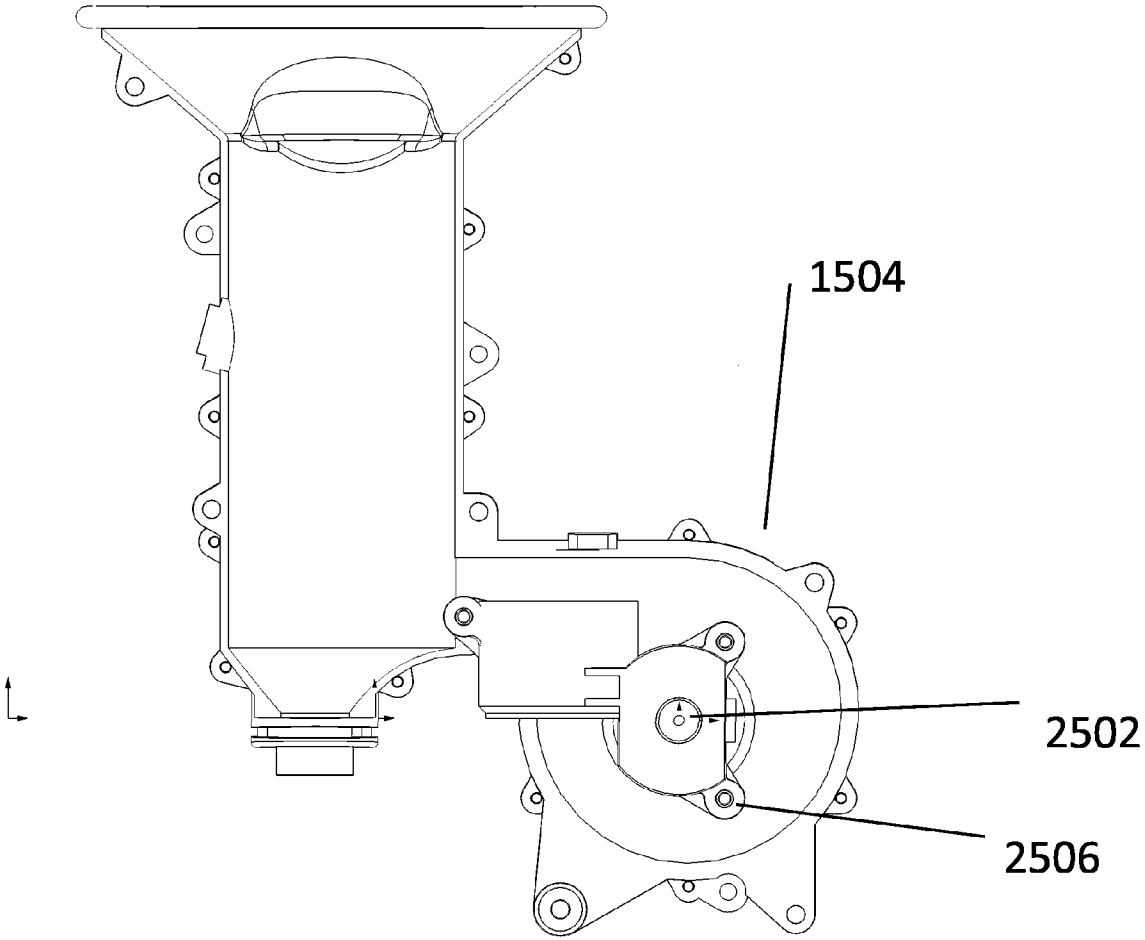
FIG. 25 is an alternative of the left side view of the inner shell housing of the alternative embodiment of the disclosure.

As shown in FIG. 23, the initiating or on/off button 1905 is directly coupled to a power control board 2318, which is powered by batteries. The batteries are held in a battery housing 2320. The battery housing 2320 is accessed through the battery door 2002. The device may be controlled by two AA batteries. In another embodiment, the device may be controlled by an electrical source of power, solar energy or through larger, smaller or multiple amounts of batteries. The battery powered power control board 2318 powers a motor 2502 (as shown in FIG. 25) which controls the impeller/fan 2316. As shown in FIG. 24, the fan 2316 is enclosed in a recess 2402 located on the left piece 1502 of the inner shell housing. The fan 2316 produces air to propel the game ball up through the elongated chute after the rinsing has occurred. As shown in FIG. 25, the motor 2502 is encased in a motor pump clip 2506 which is connected to the right piece 1504 of the inner shell housing. The device is approximately 5 inches wide, 6 inches deep and 9 inches tall. In another embodiment, the device may be of any width, depth, length and height.

Connecting the right inner shell piece with the left inner shell piece (FIG. 15 and FIG. 16) create the device's elongated chute, circular slot and finger depressions. In another embodiment, the elongated chute, circular slot where the game ball is inserted and the finger depressions are configured as one piece. In another embodiment, the device may be equipped with a longer interior chute which may allow for the cleaning of multiple game balls. In another embodiment, the device may include a chute where a game ball is inserted in addition to a separate chute for the game ball to be returned. In another embodiment, the LED indicator light may be illuminated with custom colors depending on the amount of players.

The application disclosed a method for cleaning a game ball including where the controller is configured to operate in a first mode where the game ball is cleaned within an elongated chute using a mixture of air and fluid; and operate in a second mode where the game ball is ejected out of the elongated chute by a thrust of air. The controller may be configured to initiate a cleaning sequence for a predetermined amount of time. The method for cleaning a game ball includes a controller initiating the lowering of opposing extruding pegs located within the elongated chute where the game ball is placed upon. The method for cleaning a game ball where the controller directs a fan to produce air and a pump to deliver fluid from a reservoir.

In another embodiment, the depressions around the exterior base may be configured to hold additional game balls. In another embodiment, the device may be configured to rinse and return multiple game balls simultaneously. In yet another embodiment, the device may be configured with multiple distraction buttons wherein a player can distract the opposing team and interrupt their concentration when playing with lights, sounds, and alarms. In another embodiment, the device may be configured to keep score such as wins overall for the night, misses, how many balls have been "cleaned." in the system, etc. In another embodiment, the device may include buttons to keep track of common game strategies and plays such as "On fire", "Balls back", or "Heating up." In yet another embodiment, the device may include speakers that work with Bluetooth technology or that is wired to an external media device such as a cellular phone, tablet or other auxiliary music devices. In another embodiment, the device may include a UV filtration light to disinfect the rinse solution after every wash. In another embodiment, the device may include filtration tablets that are deposited after every use to clean the rinse solution. In another embodiment, the device may be configured to accommodate and accept additional accessories such as snap-on ball holders, cup holders or bottle holders. In another embodiment, the device may include a bottle opener.

Various other components may be included and called upon for providing for aspects of the teachings herein. For example, additional materials, combinations of materials and/or omission of materials may be used to provide for added embodiments that are within the scope of the teachings herein. In the present application a variety of variables are described, including but not limited to components and conditions. It is to be understood that any combination of any of these variables can define an embodiment of the disclosure. Other combinations of articles, components, conditions, and/or methods can also be specifically selected from among variables listed herein to define other embodiments, as would be apparent to those of ordinary skill in the art.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. A device for cleaning a game ball, including:

an outer shell housing including a first side and a second side; the first side configured to align with the second side; said connected outer shell sides adapted and configured to form a recess for receiving a reservoir of fluid and for accommodating inner shell housing pieces;

an inner shell housing including a first piece and a second piece; the first piece configured to align with the second piece; said connected inner shell housing pieces adapted and configured to form a funnel for receiving the game ball and further configured to form an elongated chute where the game ball is transported; and a fan; said fan located within the inner shell housing and which is in communication with the elongated chute;

a pump; said pump located within the reservoir and which is in fluid communication with the elongated chute;

a power control board for controlling the fan and pump to deliver air and fluid mixture over the game ball.

2. The device of claim 1, further including an LED indicator light when the game ball is being cleaned.

3. The device of claim 1, wherein the reservoir is secured with a fluid leak prevention gasket.

4. The device of claim 1, wherein the reservoir is configured with a mesh filter to capture fallen debris off the game ball after rinsing.

5. The device of claim 1, wherein the funnel includes a circular lip.

6. The device of claim 1, wherein the circular lip includes depressions for lifting the game ball off the device.

7. The device of claim 1, wherein the first side and second side of the outer shell housing include a depression for the removal of the reservoir.

8. The device of claim 1, wherein the device is battery operated.

9. The device of claim 1, further comprising an initiation button which is configured to initiate a cleaning sequence.

10. The game ball cleaning device of claim 1, wherein the game ball includes a ping pong ball.

11. The game ball cleaning device of claim 1, wherein the housing includes a plurality of indents for the placement of advertisement stickers.

12. The game ball cleaning device of claim 1, wherein the inner shell housing pieces include opposing extruding pegs for holding a game ball in place while being rinsed.

* * * * *